US005517083A

United States Patent [19]

Whitlock

[11] Patent Number: 5,517,083

[45] Date of Patent: May 14, 1996

[54] METHOD FOR FORMING MAGNETIC FIELDS

[76] Inventor: Stephen A. Whitlock, 122 S. Lawsona Blvd., Orlando, Fla. 32801

[21] Appl. No.: 361,205

[22] Filed: Dec. 21, 1994

[51] Int. Cl.[6] ..... H01J 7/24

[52] U.S. Cl. ..... 315/111.71; 335/219; 336/227; 376/121; 376/142; 313/153

[58] Field of Search ..... 315/111.71; 313/153, 313/231.31; 376/121, 142, 139

[56] References Cited

U.S. PATENT DOCUMENTS

| | | | |
|---|---|---|---|
| 3,170,841 | 2/1965 | Post | 176/5 |
| 3,369,140 | 2/1968 | Furth | 313/153 |
| 3,445,722 | 5/1969 | Scott et al. | 335/213 |
| 3,461,033 | 8/1969 | Michel et al. | 176/6 |
| 3,523,206 | 8/1970 | Drabier et al. | 313/161 |
| 3,582,849 | 6/1971 | Post et al. | 335/213 |
| 3,614,525 | 10/1971 | Uleski | 315/111.21 |
| 3,668,067 | 6/1972 | Christofilos | 176/5 |
| 3,677,889 | 7/1972 | Coensgen et al. | 176/3 |
| 4,007,392 | 8/1977 | Valfells et al. | 313/154 |
| 4,127,442 | 11/1978 | Logan | 176/3 |
| 4,233,437 | 11/1980 | Limpaecher | 313/231.3 |
| 4,292,568 | 9/1981 | Wells et al. | 315/111.4 |
| 4,342,720 | 8/1982 | Wells | 376/107 |
| 4,354,999 | 10/1982 | Priest | 376/142 |
| 4,430,290 | 2/1984 | Kiryu | 376/134 |
| 4,446,096 | 5/1984 | Auchterlonie | 376/145 |

FOREIGN PATENT DOCUMENTS

| | | | |
|---|---|---|---|
| 3810197 | 10/1988 | Germany | 315/111.71 |

OTHER PUBLICATIONS

Wm. Sweet, "Nuclear Fusion Advances", pp. 31–36, *IEEE Spectrum,* Feb. 1994.

*Primary Examiner*—Robert J. Pascal
*Assistant Examiner*—Michael B. Shingleton
*Attorney, Agent, or Firm*—Allen, Dyer, Doppelt, Franjola & Milbrath

[57] ABSTRACT

Magnetic point pole placements in a generally spherical arrangement of electromagnets forms a magnetic field. The magnetic arrangements use five regular geometric structures and geodesic triacon breakdowns of these geometric structures. Magnets are placed at the corners of each of the solids, oriented along the radii of the solid, with similar poles pointing inward. The magnets are at the same distance from structure center, and are identical in length and strength. Magnetic vector maps of fields within the structures are compared to current magnetic mirror plasma confinement fields. Non-symmetrical arrangements of magnets using regular geometric structures include specific magnets removed and new magnets added, resulting in a local monopole magnetic field and local inner field reversed mirror, depending on whether just one or both poles of the additional magnet are within the structure. Finally, the nesting of solids is presented.

18 Claims, 22 Drawing Sheets

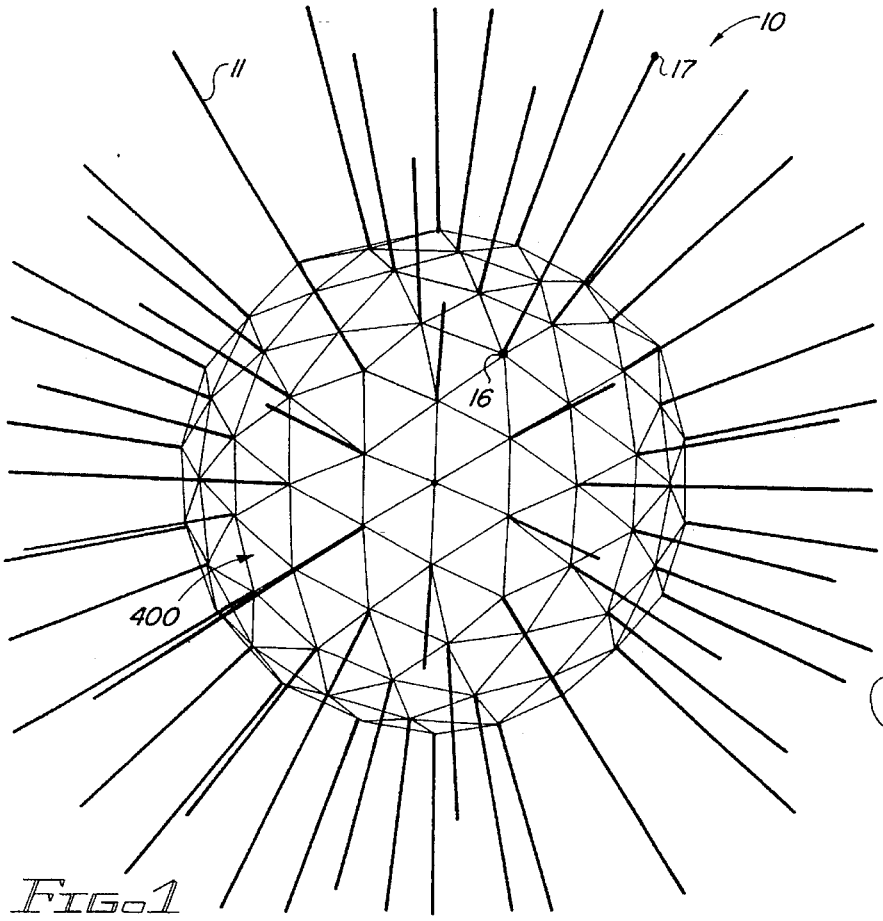
FIG. 1
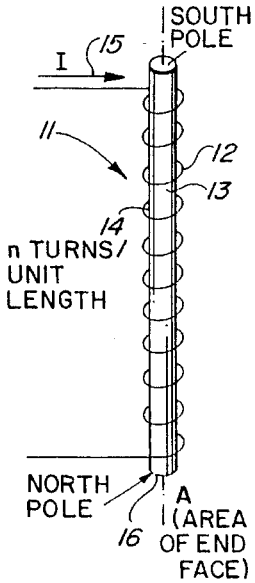
FIG. 1a
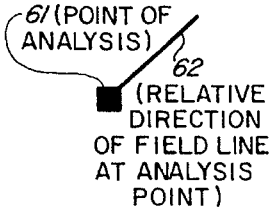
FIG. 1d
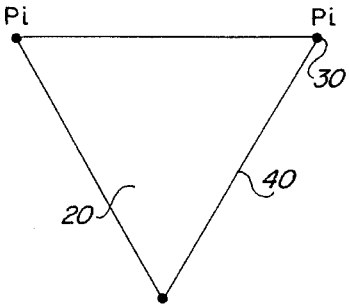
ICOSEHEDRON
FIG. 1b(1)
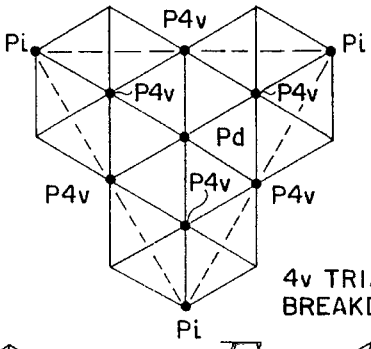
4v TRIACON BREAKDOWN
FIG. 1b(3)
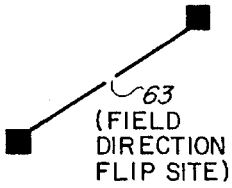
FIG. 1e
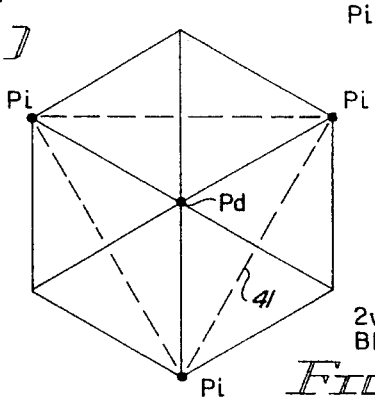
2v TRIACON BREAKDOWN
FIG. 1b(2)

METHOD FOR FORMING MAGNETIC FIELDS

BACKGROUND OF INVENTION

1. Field of Invention

The present invention relates generally to magnetic fields and particularly to fields for containing charged particles and ionized gases such as plasmas used in nuclear fusion reactors.

2. Background Art

Plasma containment by magnetic fields has followed two main pathways in an attempt to successfully sustain a nuclear fusion reaction. The open-ended type, such as the magnetic mirror, have suffered from large plasma losses through the mirror ends. The toroidal type, such as the tokamak, have suffered losses as a result of the magnetic field lines exhibiting a convex rather than a concave curvature with respect to the particles traveling in the torus.

The magnetic mirror effect is the result of a plasma particle moving along the field lines toward a region of increasing field strength, the mirror, and being repelled by a repulsive force reacting on its circular current. The simple mirror is achieved by a pair of coils which have fields of similar polarity. The combined field forms two magnetic mirrors between which a plasma can be trapped. The major plasma losses occur with particles having a travel path that is oriented along the field line directly through the center of either coil, and thereby through the center of the mirrors. Several different configurations of mirror-type magnetic fields have been proposed to address the end loss problem. Mirror cells have been linked together to form roughly a toroidal structure to eliminate the mirror ends by connecting them to the next adjacent mirror (U.S. Pat. No. 3,170,841 and 3,728,217). Simple mirrors suffer the same problem of convex field lines as toroidal structures. If the current in one of the coils of a simple mirror is reversed, a magnetic cusp is formed. This configuration has, in addition to the usual mirrors, a spindle-cusp mirror extending 360 degrees in azimuth. This changed field line curvature to concave, but resulted in additional plasma losses at the cusp plane between the two mirrors. Cusp mirrors have been proposed that were linked into toroidal shapes (U.S. Pat. No. 3,668,067), with a variety of mechanisms that were meant to reduce the losses from the respective spindle-cusp planes (U.S. Pat. No. 3,461,033). Although the cusp type magnetic field is more stable due to the concave condition, the existence of a magnetic field zero point at the center of the structure results in the impairment of a single-particle confinement. The magnetic moment is no longer an adiabatic invariant of the system, and a particle passing through the zero field point will have a motion which bears no relationship to the motion prior to its passage through the zero field point. Annular mirrors were proposed to define an annular magnetic field region having a non-zero minimum field and still retained the flux line curvature that is convex from the central plasma surface (U.S. Pat. 3,369,140). The simple mirror structure can be altered by the addition of four Ioffe bars carrying current in alternate directions. The plasma is distorted into an asymmetric shape, and finds itself in an absolute magnetic well, with the field strength increasing in every direction. Any structure with a minimum B field, or a magnetic well, will have added stability, as plasma will tend to drift to regions of lower field strength. A further refinement of this configuration is to combine the Ioffe bars and the main mirror coils into a single winding. The winding has the shape of a seam on a baseball and is called a baseball coil. Enhancements of this type of cusp magnetic mirror arrangements include the multiple seam baseball coil (U.S. Pat. No. 3,491,318) and the Yin-Yang coil (U.S. Pat. No. 3,582,849). These coils had the added benefits of approximating three-dimensional symmetry, but in all cases plasma losses occur at points and lines of symmetry within the structures. Both baseball and Yin-Yang coils have been used as tandem mirrors to minimize losses from the ends of a solenoid. In these cases the two types of coils act as plugs to help confine the plasma in the central solenoid. A polyhedral arrangement of multiple cusp magnets was proposed to eliminate the major cusp plane associated with most cusp mirror systems (U.S. Pat. No. 4,007,392). This structure also had the advantages of a nearly spherical symmetry to the confinement field, and the generation of a minimum B field at the center. The structure did still have the center of the individual mirrors as loss vectors. Contrasting to the simple mirror approach is the field reversed mirror approach, in which some of the inner magnetic field lines close back on themselves, creating a region in which plasma is more efficiently trapped. Confinement should improve since trapped particles must diffuse across the closed field lines before they can escape through a mirror. The more prominent approaches include the Astron scheme, field reversed ion rings formed by cusp injection, field reversed theta pinch, and the adiabatic compression of plasma gun injected vortices. A more recent method produces a field-reversed plasma ring by a coaxial plasma gun, and confines the ring into the minimum B-field of a magnetic mirror (U.S. Pat. No. 4,314,879).

More recent attempts at confinement have centered on the toroidal approach. One proposed solution for the drift problem of toroidal confinement was the Stellarator, where helical windings provided shear and rotational transforms. In one case, a single winding is in the form of a figure eight. The drift motion in this field can be minimized by the particles repeated motion through the confinement region, making one loop near the outer edge, which would then become the other half of the figure eight and be near the inner surface of the structure. Poloidal coils have been added to toroidal windings to address sheer, as well as containment coils with windings in layers with different pitch, creating a "high shear" configuration. The tokamak approach has a toroidal magnetic field supplemented by a poloidal component produced by a large current in the plasma itself. Multiple cusp mirrors as the interior walls (U.S. Pat. No. 4,233,537) and pinch coils to better produce a concave field (U.S. Pat. No. 3,523,206) have been tried. The multipole approach has their magnetic field entirely or primarily in the poloidal direction. The typical multipole has four rings defining the inner, outer, top, and bottom edges of a torus. The current can be carried in the same direction, so that there is a minimum B field in the center region. The current can also be carried in alternating opposite directions, forming a linear cusp between each adjacent pair of coils. This linear cusp suffers from plasma losses like any cusp-mirror, in this case along the cusp line. An approach to reduce losses from most forms of line cusps and point cusps was to place reflector fields along the cusp loss regions (U.S. Pat. No. 4,430,290). The very recent work has centered on refinements of the toroidal approach, with no real new schemes being offered.

A thorough review of the history of magnetic fusion research at Lawrence Livermore Laboratory is found in the May 1978 issue of Energy and Technology Review Lawrence Livermore Laboratory, encompassing the major approaches in magnetic mirror confinement. A general overview of the physics of magnetic confinement of plasma can be found in Francis F. Chen's Introduction of Plasma Physics, published by Plenum Press, New York, 1974, with chapter nine being devoted to the problems associated with controlled nuclear fusion, including discussion of the advantages and disadvantages of all major approaches that have been attempted.

Technical References Cited:

| | | | |
|---|---|---|---|
| U.S. Pat. Nos. | 3,170,841 | 1965 | Post |
| | 3,369,140 | 1968 | Furth |
| | 3,461,033 | 1969 | Michel |
| | 3,491,318 | 1970 | Henning |
| | 3,523,206 | 1970 | Drabrer |
| | 3,582,849 | 1971 | Post |
| | 3,668,067 | 1972 | Christofilos |
| | 3,728,217 | 1973 | Dandl |
| | 4,007,392 | 1977 | Valfells |
| | 4,233,537 | 1980 | Limpaecher |
| | 4,314,879 | 1982 | Hartman |
| | 4,430,290 | 1984 | Kiryu |

Energy and Technology Review, May 1978, Lawrence Livermore Laboratory

Introduction to Plasma Physics, chapter 9, Plenum Press, NY, 1974, Francis F. Chen

SUMMARY OF INVENTION

A multipole magnetic well for plasma confinement is achieved with a plurality of current-carrying coils placed on planes corresponding to the facets of a regular polyhedron. Significant changes in the field shape are brought about by the addition of magnets at the points of symmetry of the polyhedrons, resulting in structures that are triacon breakdowns of the regular polyhedron. Because of slight deviations from perfect symmetry, using these triacon breakdowns to locate the magnet generate multiple field shapes within the structure, with the inner field being distinct and different from the outer field near the internal edge of the structure. The inner field is changed by the exclusion of specific electromagnets in the structure thus generating an inner field that is identical to a cusp-mirror system, but in this case, it is created by the absence of two magnets. This inner cusp-mirror is within a multiple cusp-mirror, with the inner cusp-mirror as the main confinement region, and the multiple cusp-mirror that occurs near the inner wall of the structure as the secondary confinement. Orientation of the two confinement fields thus dramatically increases confinement compared to that of individual fields, and both fields are created by the same general structure geometry. The orientation at the spindle-cusp of the inner cusp-mirror to the multiple-cusp has dramatically reduced the field losses at the spindle-cusp. In addition, the multiple cusp-mirror that comprises the edge is formed by magnets of similar polarity, forming the poles of opposite polarity at the points of symmetry, or by magnets of both polarities, replacing "created" poles at the points of symmetry with actual poles. In addition to the use of DC magnets at the points of symmetry, AC magnets can be used to reduce the linear cusp losses associated with the multiple cusp. The creation of non-adiabatic centers on loss vectors associated with the centers of the inner mirrors provides a method for reducing losses of the main inner cusp-mirror. The magnets examined in the present invention structure are of a diameter considerable smaller than the distance between any adjacent magnets. And finally, the inclusion of a center magnet creates a local monopole central field or an inner field reversed mirror.

The present invention provides a method for confining a plasma within a multipole magnetic well generated by a plurality of current-carrying coils placed at the corners of triacon breakdowns of the regular polyhedral structures. The polyhedral structures used are the tetrahedron (four sides), cube (six sides), octahedron (eight sides), dodecahedron (twelve sides), and icosahedron (twenty sides).

One object of the invention is to use the triacon breakdown of these polyhedrons to generate a slight non-perfect symmetry that allows the formation of inner fields different from the outer field near the internal edge of the structure. Due to the subtle asymmetry in the side length of the triangles that form the geodesic structure of the triacon breakdown, the formation of an inner and an outer field is generated, with the inner field being the common symmetry of the combined fields of the icosahedron and the dodecahedron, and the outer field being their differences. As in the original regular polyhedron, triacon breakdowns result in a minimum B field, or magnetic well, being formed.

Another object of the invention is the creation of zero B fields, or non-adiabatic centers, at the points of symmetry between poles, and the utilization of these non-adiabatic centers along major loss lines for preventing particle losses by dramatically changing the direction of the particles that are following loss vectors.

A further object of the invention is to form a mirror as the inner field by the removal of specific magnets in the structure. Removing a single magnet will result in the formation of a single mirror as the inner field. Removing two magnets that are opposite to each other will result in the formation of a cusp-mirror as the inner field. In this case the cusp-mirror is formed by the absence of two magnets, not by the use of two magnets as in a normal cusp-mirror. This will generate two established types of confinement fields, an inner cusp-mirror and an outer multiple cusp mirror, by the use of a single structure, and that the combination of the two fields is an enhancement over each field individually. The particles that escape from the primary inner field must also escape from the secondary outer field. The vector orientations that are possible as a result of escape from the cusp-mirror may not be compatible with the loss orientations of the multiple cusp, thereby improving the confinement of the outer multiple cusp by reduction of particles that coincide with loss vectors. Additional symmetrical removal of specific magnets will result in the formation of multipole cusp mirrors as the inner field. The orientation of the inner field spindle-cusp mirror to the outer field multiple cusp mirror, when the two magnets removed represent the top and bottom poles of the icosahedron, is such as to prevent any straight pathway from the inner field to the inner edge of the structure as a result of the proximity and orientation of the outer multiple cusp mirror, in which no individual mirror of the multiple cusp mirror is within the plane of the spindle-cusp mirror of the inner field.

A further object of the invention is the use of poles of opposite polarity in further triacon breakdowns of regular solids, thus removing non-adiabatic centers of a multiple cusp from within a confinement region and placing them close to an interior wall. In the case of the structure where the top and bottom pole of the icosahedron have been removed, an addition of opposite poles in the triacon breakdown results in the formation of a non-adiabatic center along the major loss vector associated with the center of two mirrors of an inner cusp-mirror, scattering potentially escaping particles at the main mirrors by the inclusion of the non-adiabatic centers along the central loss vector.

Another object of the invention is the use of an AC/DC combination mode, where the original structure is operated in a DC mode and the additional triacon breakdown is operated in an AC mode. In the AC mode, linear-cusps near the inner edge of the structure that are generated around the individual mirrors of the multiple-cusp will be kept in constant motion, and not substantially change the inner field.

Another object of the invention is the inclusion of a magnet with one pole at the center of the structure. This will generate a "local" monopole field as the inner field, with a minimum B field that is somewhat spherical between the center of the structure and the inner wall.

A final object of the invention is the inclusion of a magnet with both poles within the structure, forming a field reversed mirror as the inner field. By way of example, two possible outer field formations are shown, each with one outer pole removed, and oriented to form non-adiabatic centers at the top and bottom of the inner field reversed mirror.

BRIEF DESCRIPTION OF DRAWINGS

Preferred embodiments of the invention as well as alternate embodiments are described by way of example with reference to the accompanying drawings in which:

FIG. 1 is a side view of a 4V triacon breakdown with magnets illustrated.

FIG. 1*a* is a representation of an electromagnet.

FIGS. 1*b*(1)–1*b*(3) illustrate the triacon breakdown progression of an icosahedron.

FIG. 1*d* illustrates a single magnetic vector, with the analysis point.

FIG. 1*e* illustrates the point of field reversal between two vectors.

DETAILED DESCRIPTION OF PREFERRED EMBODIMENT

Glossary

Cusp magnetic field—Magnetic mirror in which the inner poles of the two magnets are of the same polarity.

Magnetic mirror—Region of increasing field strength. As a particle moves from a weak-field region to a strong field region, the increase in the field strength causes the forward motion of the particle to be converted into a perpendicular component. If the field in strong enough, the forward motion becomes zero and the particle is reflected, hence the term "mirror".

Magnetic well—Field in which the field strength increases in every direction.

Non-adiabatic center—Area of vanishing field strength, in which a particle that passes through the center will not have the same trajectory upon exiting that it originally had.

Poloidal field—Field oriented around the circle formed as a slice through the torus.

Polyhedron—One of the five regular solids. These are solids which have identical faces and angles. The five are the trigonal pyramid, cube, octahedron, dodecahedron, and icosahedron, which have four, six, eight, twelve, and twenty identical sides, respectively.

Spindle-cusp mirror—Mirror field that forms in a magnetic cusp that is perpendicular to the two magnets and at the midpoint between the two, and that extends 360 degrees in azimuth.

Toroidal field—Field oriented around the major axis through the center of the torus.

Torus—In simplest terms, donut shaped. Triacon breakdown—A particular breakdown of the icosahedron and the octahedron, in which the centers of the faces of the original structure are joined to the vertices to form the new triangular faces. With a triacon breakdown, none of the edges of the original structure show.

DETAIL DESCRIPTION

Figure 1C:
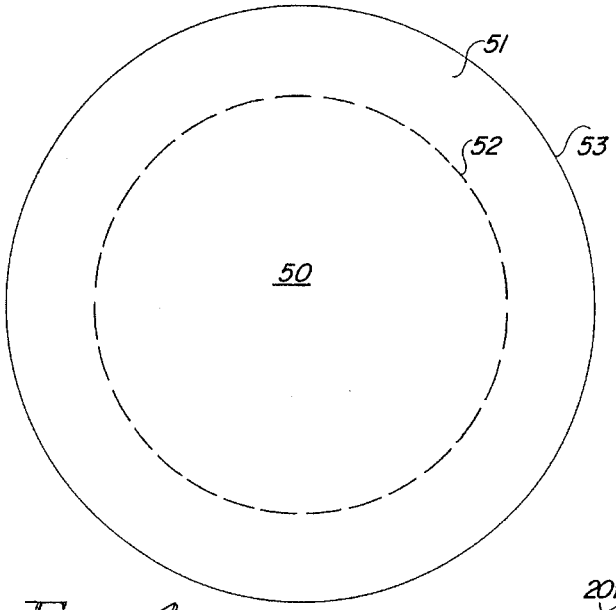
FIG. 1*c* is a schematic representation of the field inside the structure.

As in FIG. 1, magnets 11 are placed at the corners of the regular polyhedrons and triacon breakdowns of the regular polyhedrons 400, forming a confinement field magnet structure 10. Inner poles 16 are those at the corner of the structure, and outer poles 17 are those away from the structure.

The field intensity at any point within the geometric shapes are calculated using the following point pole approximation.

$$H = ((nIA)/4\pi) \cdot \sum_{p=1}^{n_p} ((1/r^2) * i_p)$$

The summation is a vector sum with south poles negative and north poles positive. The quantity $n_p$ is the number of magnets. The term $i_p$ refers to the unit vector. The quantity nIA is the pole strength, with n being the number of turns per unit length 14, with I being the current 15 through the magnet 11, and with A being the area of the end face 16 of the magnet 11, as illustrated in FIG. 1*a*. By way of example, this quantity is not included in the vector sum, since the magnets are identical. As the size of the geometric shapes is changed, H scales as the inverse square of the radius of the shape. The assumptions in point pole approximations for calculating magnetic fields are that the magnets are very long, slender, and uniformly magnetized. FIG. 1*a* illustrates the magnet 11 as one having a core 13 in addition to the coil 12, but the core 13 does not have to be present to achieve the desired field shapes.

The term "triacon breakdown" refers to a particular geometric division of a regular polyhedron. By way of example, triacon breakdowns of an icosahedron are shown in FIGS. 1*b(1)*–*1b*(3). The icosahedron is composed of twenty equilateral triangles, with one face 20 illustrated in FIG. 1*b*(1). The poles Pi are placed at the corners 30. In the case of the 2V triacon breakdown of FIG. 1*b*(2), each side 40 of the icosahedron is divided in two, with smaller isosceles triangles 21 replacing the equilateral triangles 20 as the faces of the structure, and the original edge 40 of the icosahedron becoming a hidden edge 41. An additional corner forms in the center of the icosahedron face 20, and the additional twenty magnets Pd of the 2V triacon breakdown are placed at the new corner in the center of the face 20. The 4V triacon breakdown in FIG. 1*b*(3) divides the original icosahedron edge 40 into four equal segments, forming smaller isosceles triangles 22, with the additional ninety magnets P4*v* of the 4V triacon breakdown being placed at the new corners.

The shift from equilateral to isosceles triangles disrupts the perfect symmetry of the original icosahedron, allowing the formation of an inner field 50 that has a different field shape from the outer field 51 that is close to the edge 53 of the structure. As illustrated schematically in FIG. 1*c*, a transition region 52 forms at the interface between the inner 50 and the outer 51 field.

The fields within these structures are represented as in FIG. 1*d*, with the numeric point of analysis 61 depicted as a square, and the relative direction of the resulting magnetic vector indicated by a line 62 away from the analysis point 61. Non-adiabatic centers where flux lines reverse are illustrated in FIG. 1*e*, with the flip site 63 indicated.

Figure 1F:
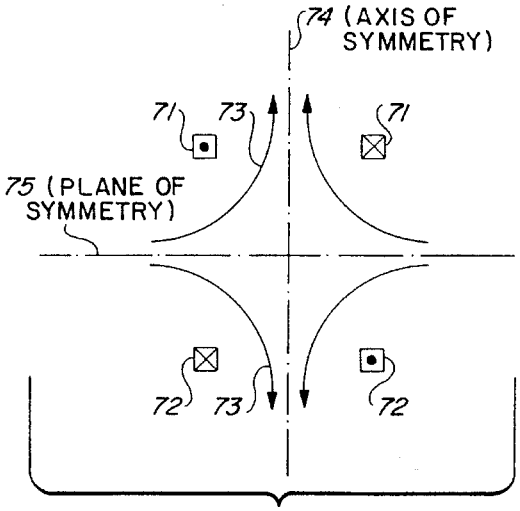
FIG. 1*f* is a schematic of a conventional cusp mirror confinement field.

One field shape that is obtained by this method is similar to a conventional cusp magnetic mirror field. The conventional field, illustrated in FIG. 1*f*, is achieved by an upper coil 71 that is oppositely charged relative to the lower coil 72. A mirror 73 is formed in the center of both coils, and a cusp mirror is formed around the plane of symmetry 75 that is between and parallel to the two coils.

Geometric Shape

Figure 2D:
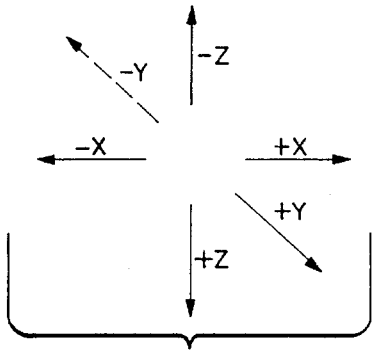
FIG. 2*d* is the orientation of FIG. 2*c* to the X, Y, and Z planes.
Figure 2B:
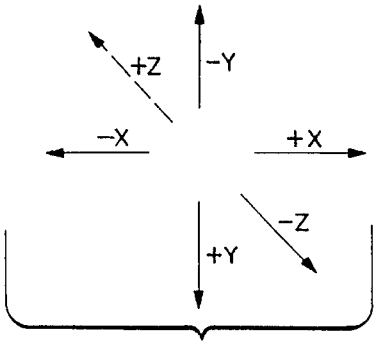
FIG. 2*b* is the orientation of FIG. 2*a* to the X, Y, and Z planes.
Figure 2C:
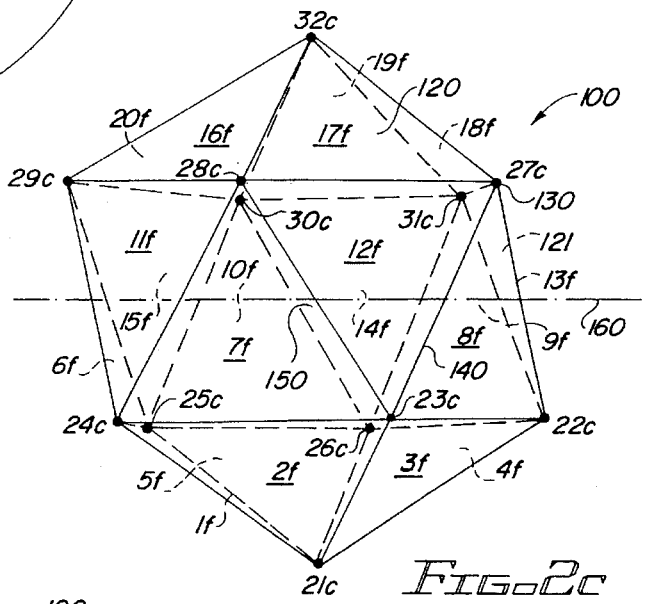
FIG. 2*c* is a side view of the icosahedron 100 of FIG. 2*a*, with faces and corners labeled as in FIG. 2*a*.
Figure 2A:
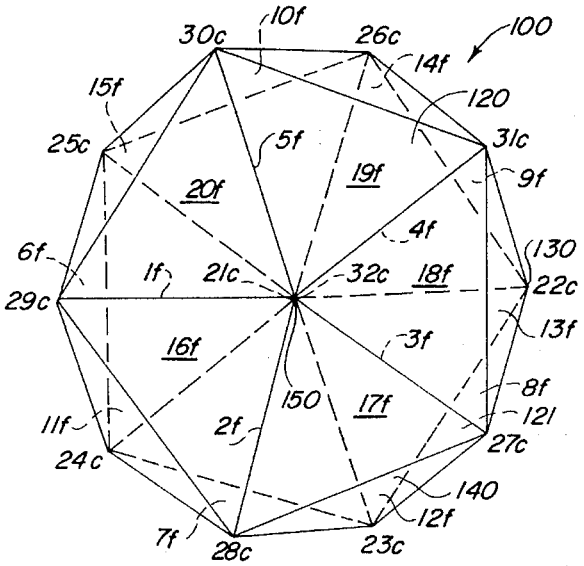
FIG. 2*a* is a top view of an icosahedron 100, with faces labeled 1*f* through 20*f* and corners labeled 21*c* through 32*c*.
Figure 2E:
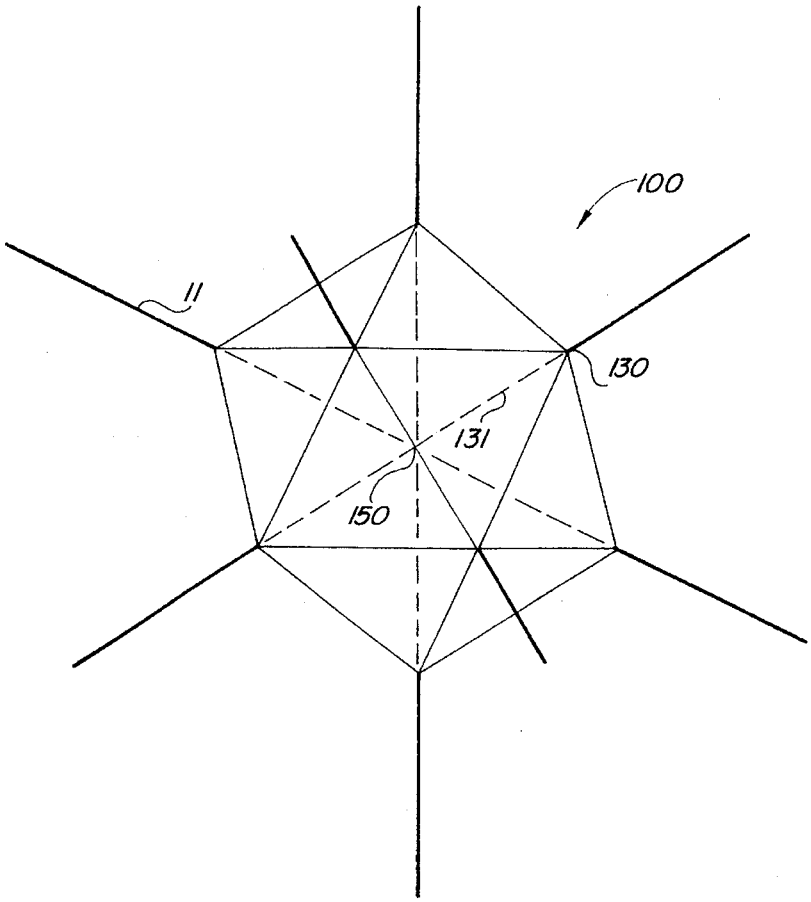
FIG. 2*e* is the same as FIG. 2*c* but with magnets illustrated.

By way of example, the first shape presented in FIG. 2*a* as a top view and in FIG. 2*c* as a side view is a regular icosahedron 100 composed of equilateral triangles 1*f*–20*f* with a relative side length of 1.589309 and an internal radius of 1.511523 from the inner poles to the icosahedron center, 150. The units are relative in the respect that the choice of yards or meters or inches would only change the units of the field intensity, but the shape of the field and the shape of the magnetic well will not change. The magnitude of the field will scale as the inverse radius of the structure, but again the shape will not change. The ratio of 1.589309 as a side length to 1.511523 as a radius is the fixed ratio of the icosahedron. One pole of a magnet 11 is placed at each corner 130 and with the axis 131 of the magnets such that the north poles point toward the center 150, as illustrated with reference to FIGS. 2*e*. If south poles were used, the vector maps would remain the same, and only the direction of the field or flux lines 110 would change. The Faces 120 are numbered 1*f*–20*f*, and the corners 130 are numbered 21*c*–*32c* with hidden faces 112 indicated by a dashed line. The graphical display of the magnetic vectors or flux lines 110 is oriented as in FIG. 2*a* with Z=0 to result in a top view, and as in FIG. 2*c* with Y=0 to result in a side view. These two vector maps are able to represent all planes of symmetry within the icosahedron, the first being all planes of symmetry, as by way of example, the plane 160 in FIG. 2*c*, that center on the faces 120, and the second being all planes that center on the corners 130 or poles. It is within these planes of symmetry that the flux lines will be closest aligned to the radii of the geometric shapes used, and if reversals of field lines occur along a radius, it will be within these planes. The flux lines 100 not within planes of symmetry will be regular transitions from one plane to the next plane. Due to symmetry constraints, reversals along a radii cannot occur outside of the planes of symmetry 160. As the icosahedron 100 is rotated around the Z axis, the vector maps at each plane of symmetry switch back and forth between Y=0 and the mirror symmetry map of Y=0, and the vector maps at planes of non-symmetry between these two maps are a regular transition of vectors from the Y=0 map to its mirror symmetry map. Because of this symmetry, all of the important aspects of the internal field within the poles can be analyzed by characterizing just the magnetic vector maps of the top, FIG. 2*a*, and one side, FIG. 2*c*. Also, in these planes of symmetry, all vectors are contained within the plane, and do not extend into or out of the plane. The radii chosen for analysis within these planes of symmetry are along the lines of symmetry in the plane, as by way of example, the radii that contain the corners 130 and at halfway points between the lines of symmetry. These radii were chosen by way of example to capture illustrative transitions that occur in the flux lines. The orientation of the plan views in FIG. 2*a* and in FIG. 2*c* are shown relative to their respective X, Y, and Z planes in FIG. 2*b* and FIG. 2*d*.

Figure 3A:
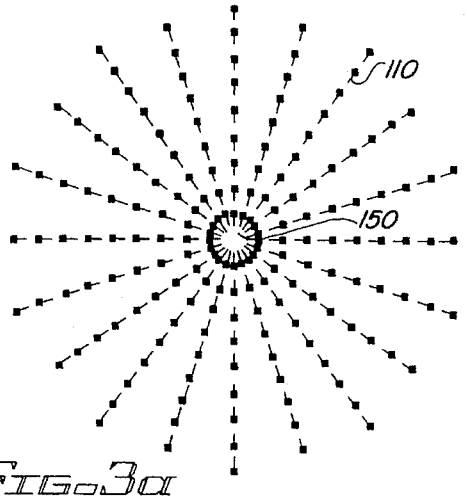
FIG. 3*a* illustrates magnetic field vectors of the top view icosahedron 100, with magnets located at each corner of the icosahedron 100, (The orientation of the field diagram is shown relative to the top view of the icosahedron, FIG. 3*b* with the corners of the icosahedron 100 labeled with the corresponding magnet number labeled 21 through 32.)
Figure 3B:
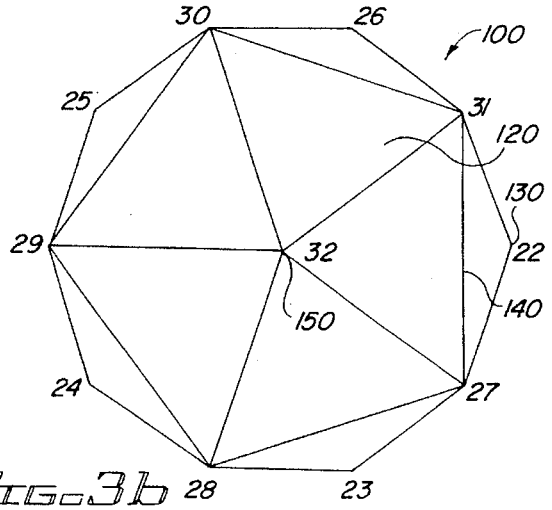
FIG. 3*c* illustrates the vector map of the side view of the icosahedron 100, with FIG. 3*d* showing the orientation of the field diagram to the side view of the icosahedron 100.
Figure 3C:
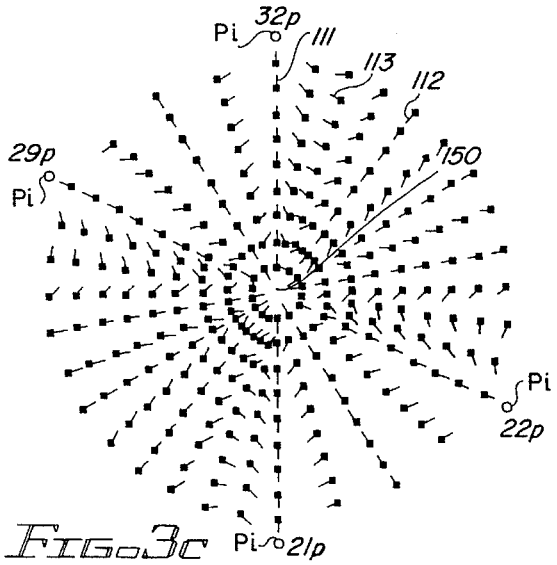
Figure 3D:
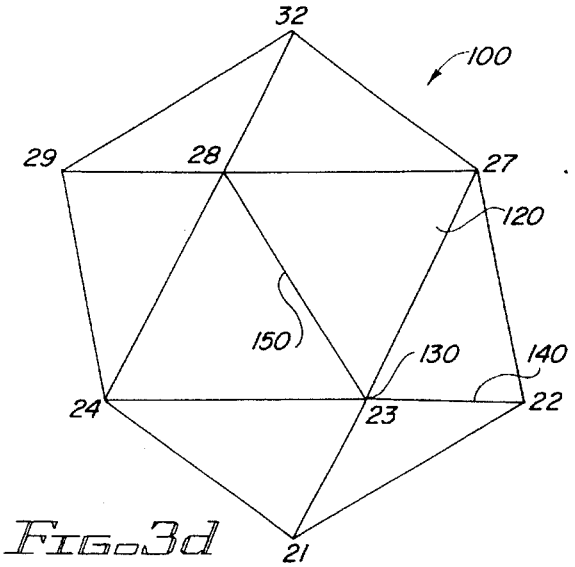

FIG. 3*a* and FIG. 3*c* shows the resultant magnetic vector maps of the icosahedron 100, with its relationship to the icosahedron 100, FIG. 3*b* and FIG. 3*d*, illustrated. In the top view, FIG. 3*a*, all resultant magnetic vectors 110 point in toward the center In the side view, FIG. 3*c*, all vectors 111 along radii that intersect with the corners 130 of the icosahedron 100 point toward the magnetic pole at the corner 130, with the pole Pi represented by a circle at the peripheral of the vector map and labeled with a pole number that corresponds to the respective corner 130. All other vectors, those that are along radii at points of symmetry between poles, point in toward the center 112 or are in transition from pole vectors pointing out to the next symmetry vector pointing in 113. What this translates to in the shape is flux lines 111 pointing directly out toward each corner 130, and lines 112 pointing directly in at the center of each face 120 and at the halfway point along each edge 140 between the corners 130. The vectors 113 between these three lines of symmetry would be regular transitions. At the center 150 of the icosahedron 100, the magnetic flux drops to zero, forming a non-adiabatic center.

Figure 4A:
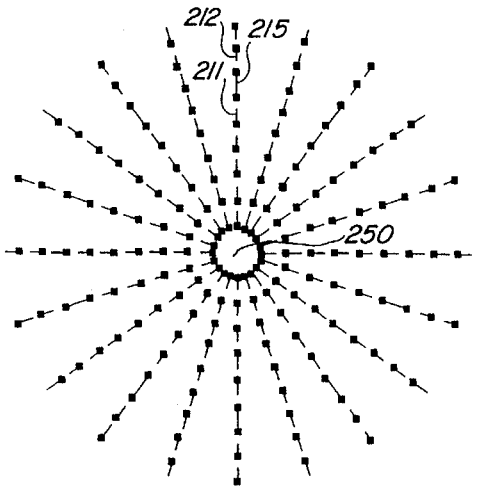
FIG. 4*a* illustrates magnetic field vectors of the top view of the dodecahedron 200, with magnets located at the corners of the dodecahedron, (The orientation of the field diagram to the dodecahedron top view.
Figure 4B:
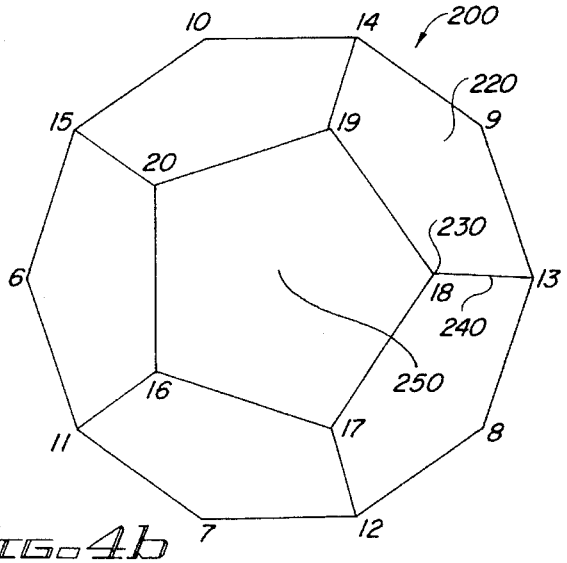
FIG. 4*b*, is shown, with the corners of the dodecahedron 200 labeled with the magnet number.)
Figure 4C:
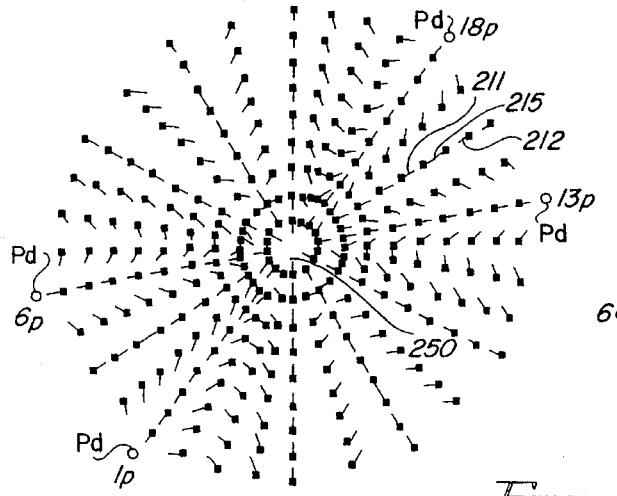
FIG. 4*c* illustrates the vector map of the side view of the dodecahedron 200, with FIG. 4*d* showing the orientation of the field diagram to the side view of the dodecahedron 200.
Figure 4D:
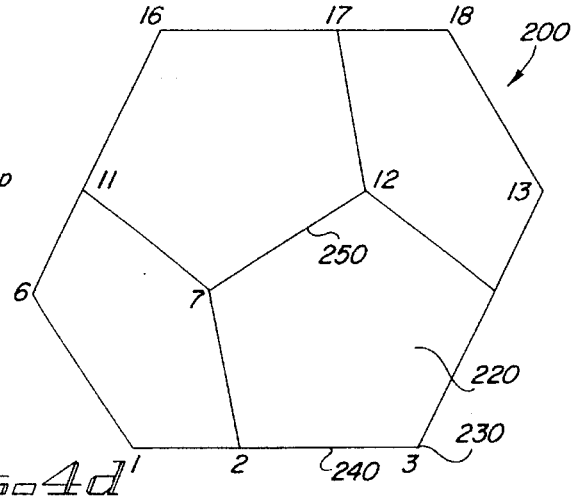
FIG. 4*e* illustrates a field diagram of the top view of the combined structure of the dodecahedron, FIG. 4*b*, and an icosahedron, FIG. 3*b*, of opposite polarity, with the poles and vectors labeled as in the original individual structures.
FIG. 4*f* illustrates the field diagram of the side view of the combined structure of the dodecahedron, FIG. 4*d*, and the icosahedron, FIG. 3*d*, of opposite polarity.

The dodecahedron 200 shown in FIG. 4*b* and FIG. 4*d* illustrates an interesting analogy to the icosahedron. In the dodecahedron 200, the center of the face 120 of the icosahedron 100 now becomes the corner 230 of the dodecahedron 200, and the corners 130 of the icosahedron 100 becomes the center 220 of the faces of the dodecahedron 200. As in the original icosahedron 100, magnets are placed at the corners 230 of the dodecahedron 200. As can be seen in the top view, FIG. 4*a*, near the center 150 of the structure, the resultant vectors are now pointing out 211, exactly the opposite of the icosahedron 100. What is different is what happens to vectors on radii that intersect with the edge 240 of the dodecahedron 200. These vectors point out 211 until the distance from the center 250 is approximately between sixty and seventy percent of the total radius. At this point 215, the vector flips 180 degrees, and now points in toward the center 212. At the transition point 215, magnetic flux drops to zero, forming a non-adiabatic center. Toward the center of the structure 250, the vector points out 211. Farther out along the radius, the vector points in 212 toward the center 250. Within the plane perpendicular to the radius at the zero flux point 215, all vectors point away from the point 215. For the inner sixty percent of the structure, the top view, FIG. 4*a*, of the dodecahedron 200 is the opposite flux direction relative to the icosahedron 100, FIG. 3*a*. The side view, FIG. 4*c*, of the dodecahedron 200 has a similar relationship to the icosahedron 100, FIG. 3*c*. The inner sixty percent of the dodecahedron 200 is very similar to the icosahedron 100 except for opposite direction. Between sixty and seventy percent of the radius, the vectors along the radii that intersect the edge 240 of the dodecahedron 200 once again flip 180 degrees. Thus flux lines point directly out 211 along radii at each corner 230, and flux lines point directly in 212 at the center of each face 220. At the halfway point along the edge 240 between two corners 230, the flux lines point out 211 for the inner sixty percent of the radius and point in 212 for the outer thirty percent of the radius. Again, at the center 250, a non-adiabatic center is formed.

Figure 4E:
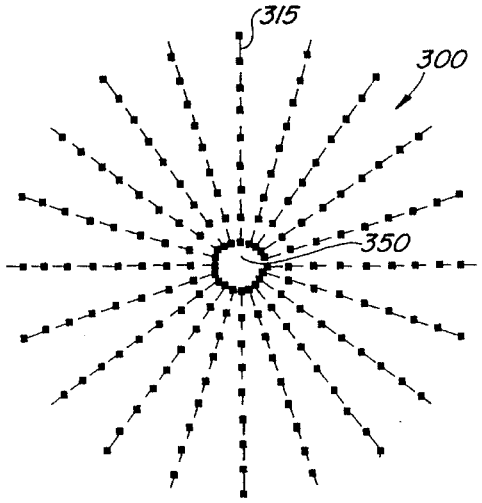
Figure 4F:
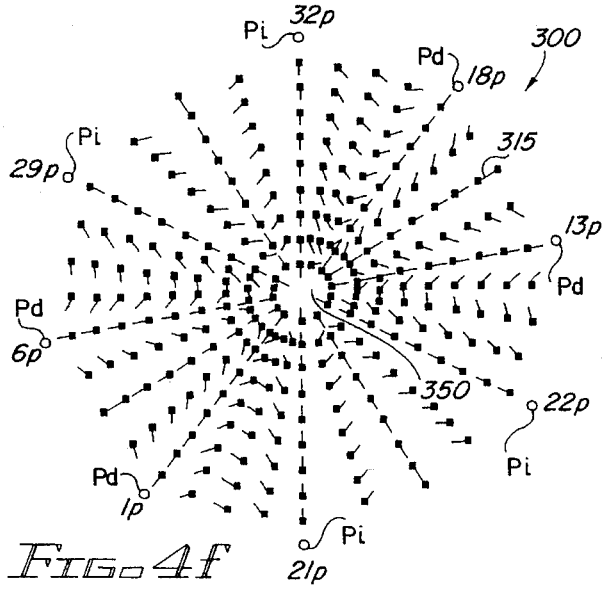

In both the icosahedron 100 and the dodecahedron 200 the flux lines at the center of the faces 120 and 220 create a pole of opposite polarity at the face center, 120 and 220. For the inner sixty percent of the solids, the fields are essentially the same between the two structures, except for the difference in direction. This similarity can be utilized in the combination of the two fields. If an icosahedron 100 of opposite polarity, one with south poles pointing toward the center 150, is combined with a dodecahedron 200, then actual poles of opposite polarity, FIG. 3*c*-Pi, are at the points of symmetry where the dodecahedron 200 had originally created them on its own at the center of each face 220. The field created by this combination is shown in FIG. 4*e* as a top view and in FIG. 4*f* as a side view. By comparing FIG. 4*a* and FIG. 4*c*, the original dodecahedron 200, with FIG. 4*e* and FIG. 4*f*, that has the icosahedron 100 of opposite polarity added, the extremely close similarity is apparent. There are some subtle differences near the edge of the structure. The vectors along the radii that intersect the edge 240 of the dodecahedron 200 no longer flip direction between sixty and seventy percent of the radius, but now flip very close to the edge of the structure 315. This moves the non-adiabatic centers, FIG. 4*a*-215 and FIG. 4*c*-215, from the point that is 60 to 70 percent of the radius from the center 250, and places it very close to the edge, FIG. 4*e*-315 and FIG. 4*f*-315. The original non-adiabatic region in the center 250 of the dodecahedron 200 is indeed a magnetic well, with rapidly increasing field strength in all directions, but the direction of particles that pass through it are uncertain. But having non-adiabatic centers 315 along some of the major loss vectors provide the advantage of preventing particles from having a straight pathway out of the confinement region, and that they lose their direction orientation and no longer are on the loss vector path upon exiting the non-adiabatic center 215 and 315. In any case, the location of the non-adiabatic centers, FIG. 4*a*-215 and FIG. 4*c*-215, in the original dodecahedron 200 can thus be moved to near the edge of the structure, FIG. 4*e*-315 and FIG. 4*f*-315, by the combining of the icosahedron 100 of opposite polarity.

Figure 5A:
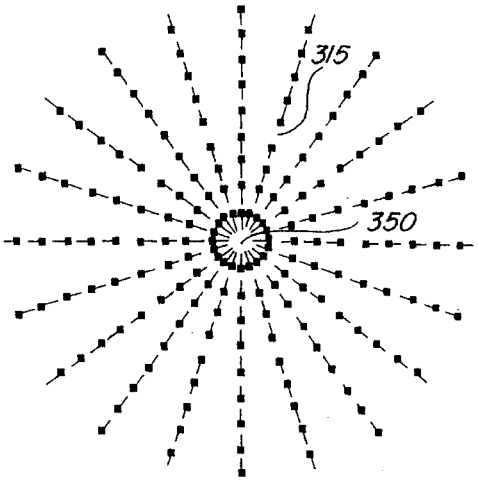
FIG. 5*a* illustrates a field diagram of the top view, FIG. 5*b*.
Figure 5B:
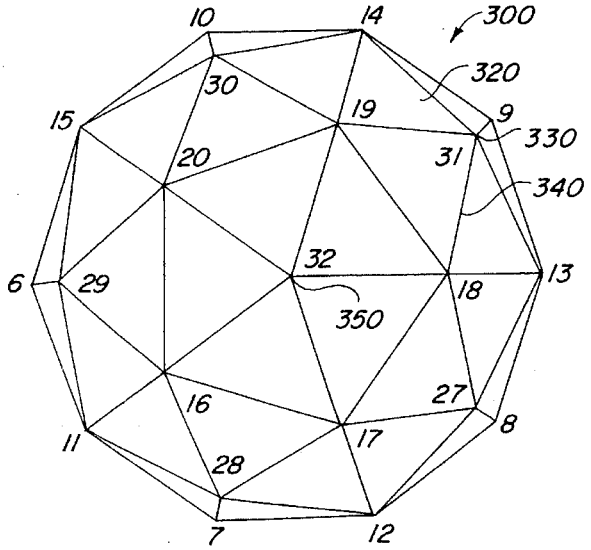
FIG. 5*c* illustrates a field diagram of the side view, FIG. 5*d*, of a 2V triacon breakdown, 300, of the icosahedron, essentially the combined structure of the dodecahedron 200 and an icosahedron 100 of similar polarity.
FIG. 5*e* is a side view enhanced field diagram of FIG. 5*c*.
FIG. 5*f*is a side view field intensity contour diagram of FIG. 5*c*, with poles labeled as in previous FIG. 5*c*.
FIG. 5*g* illustrates a field diagram of the top view and FIG. 5*h* illustrates a side view of a 4V triacon breakdown 400, where the added magnets are of opposite polarity to the original 2V triacon breakdown 300.
FIG. 5*i* is an enhanced field side view of 5*h*.
FIG. 5*j* is a field intensity contour diagram of 5*h*.
Figure 5C:
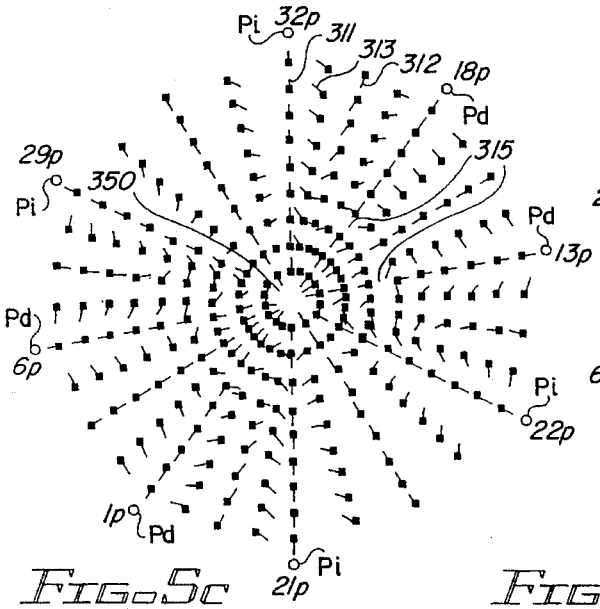
Figure 5D:
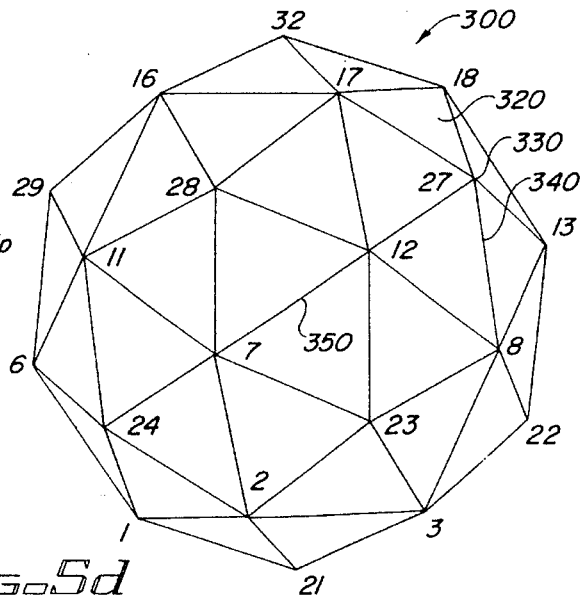
Figure 5F:
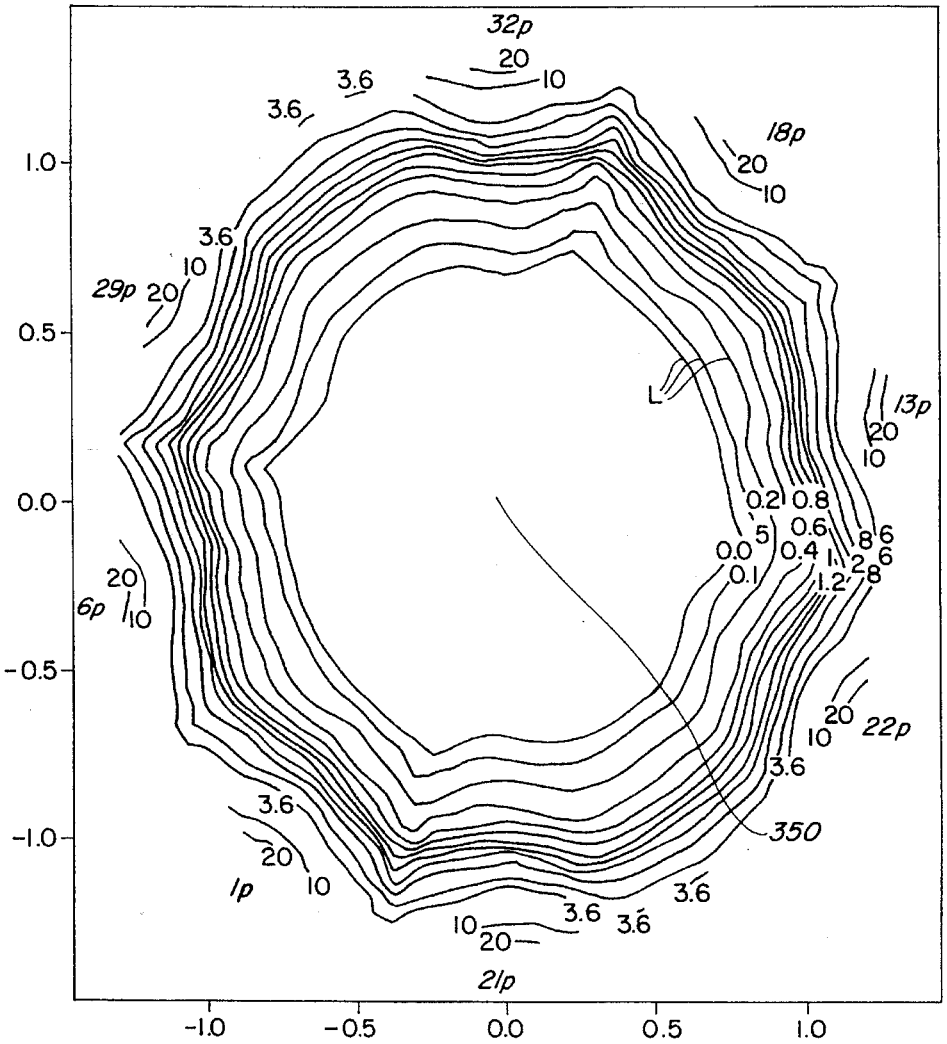
Figure 5E:
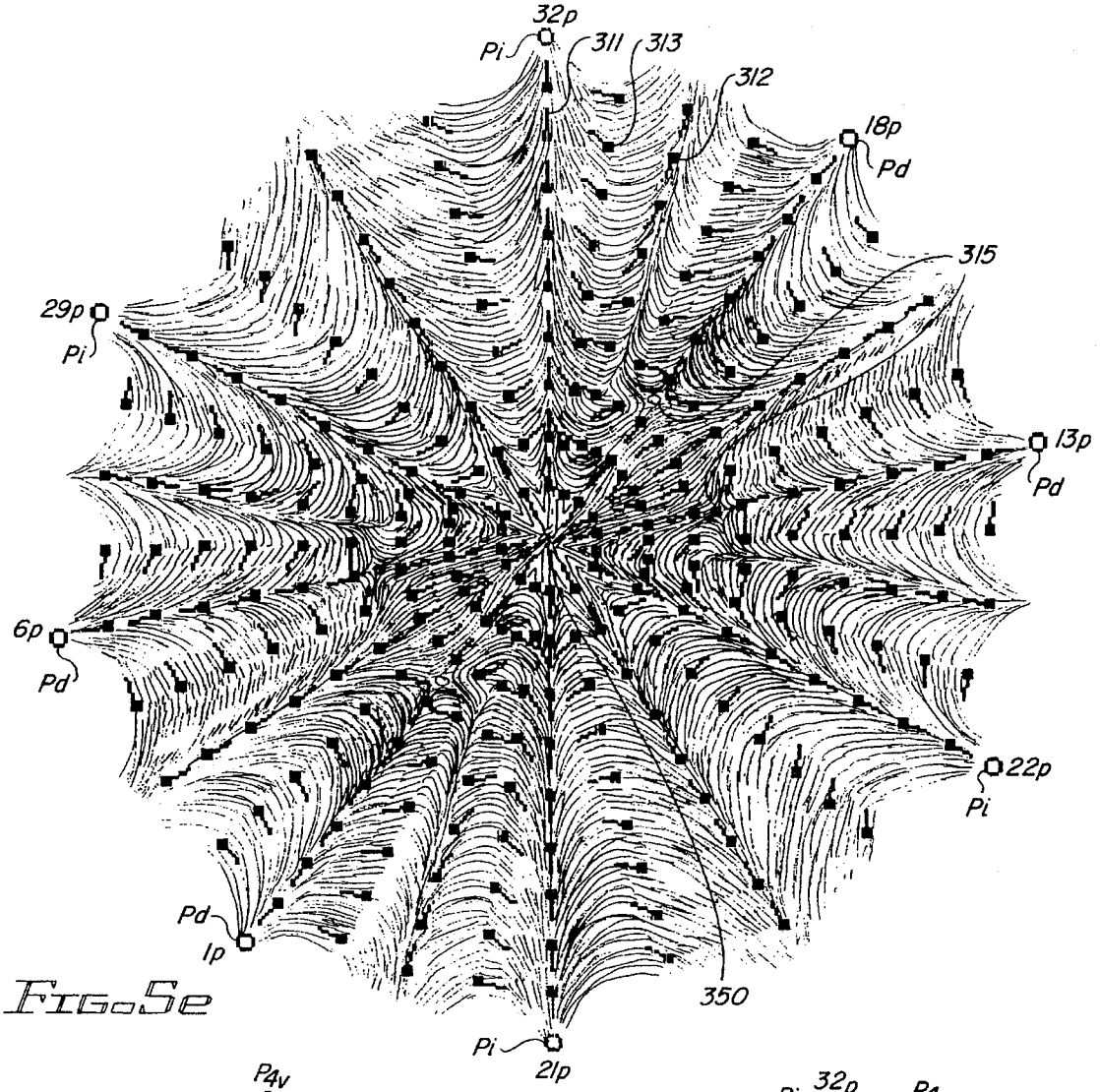
Figure 5G:
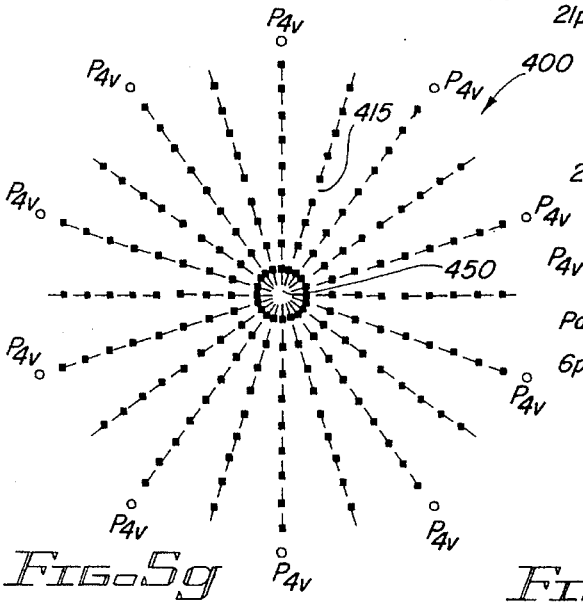
Figure 5H:
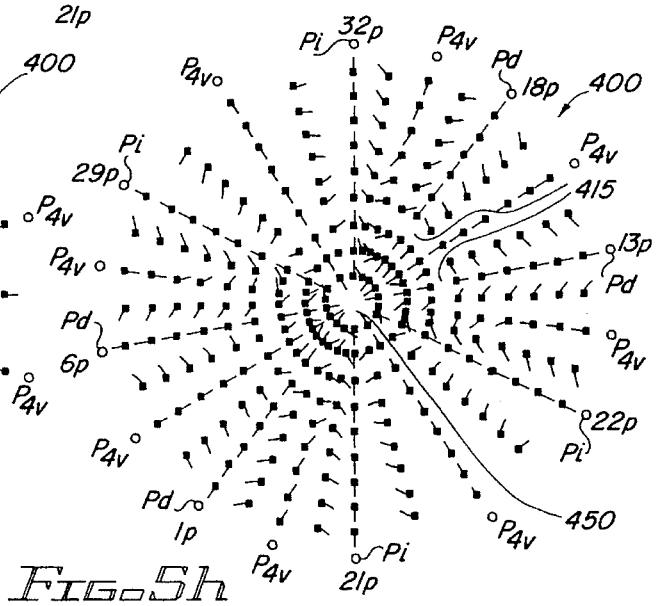
Figure 5I:
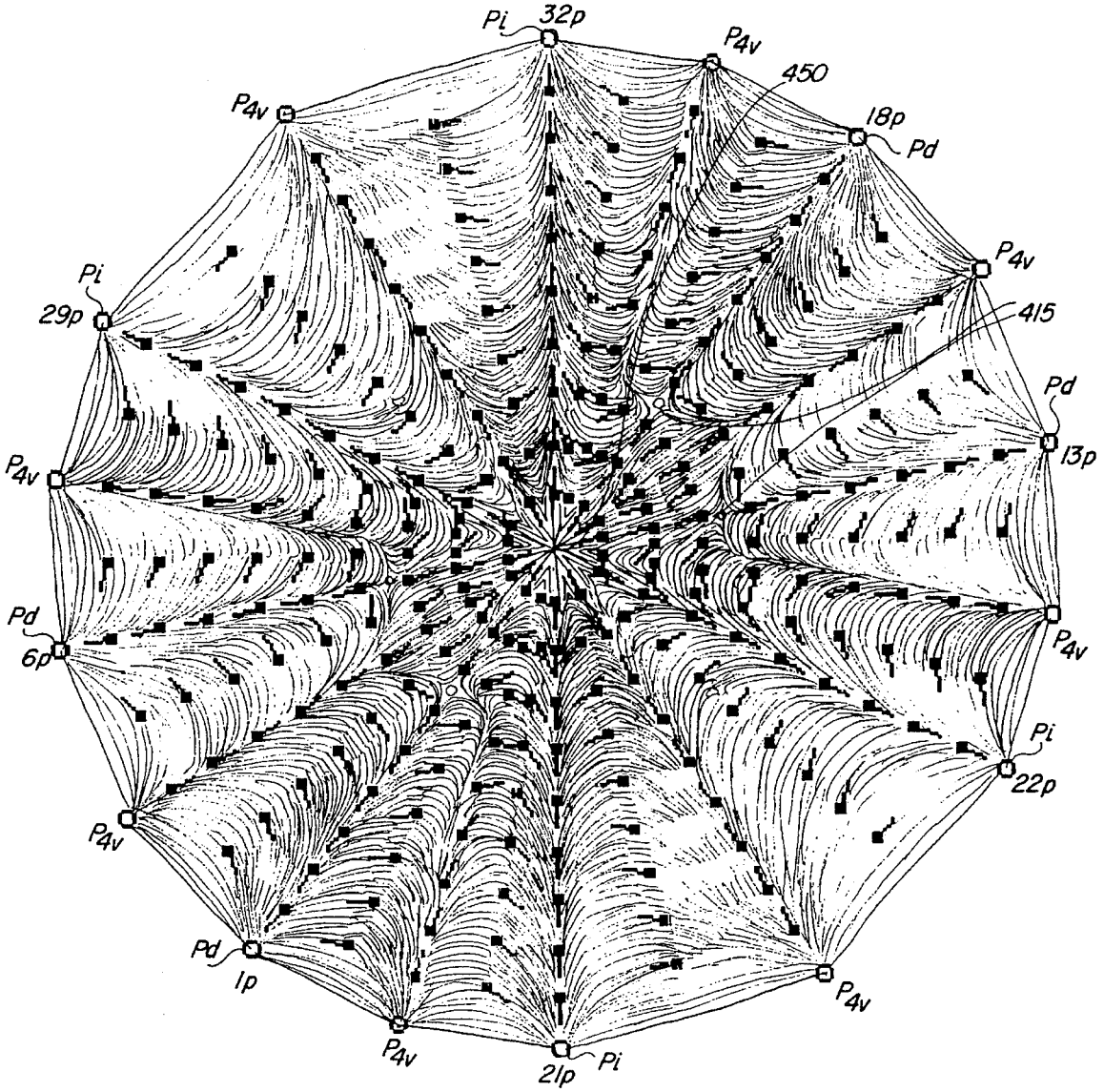
Figure 5J:
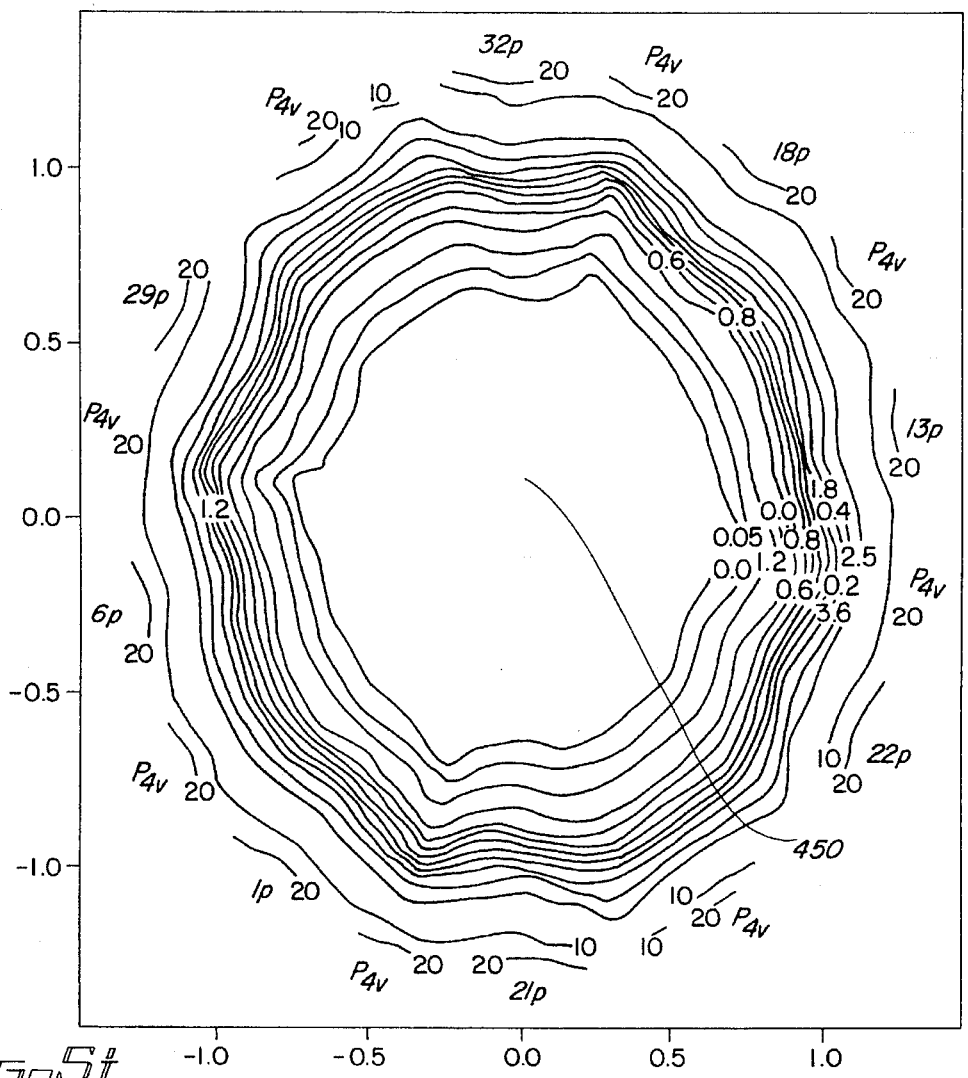

The two structures can also be combined to form one structure 300 with a common polarity with all north poles toward the center 350. The additional twenty magnets Pd of the dodecahedron 200 when combined with the twelve magnets Pi of the icosahedron 100 form a 2V triacon breakdown 300 of the icosahedron 100, according to terminology in the art of geodesic domes. "Triacon" is a term referring to a particular breakdown of the icosahedron 100, and involves joining the centers of the faces 120 to the vertices or corners 130 and forming new triangles. In a 2V or 4V triacon breakdown, the 2 or 4 refers to the number of divisions that have been made in the original icosahedron edge 140. FIG. 5*a* as a top view and FIG. 5*c* as a side view illustrates the magnetic vector maps of a 2V triacon breakdown 300, with FIG. 5*b* and FIG. 5*d* indicating the relationship to the geometric shape. The vectors 311 along radii that intersect corners 330 point outward when in close proximity to the poles Pi, Pd, but along the radii that originally intersected the corners 230 of the dodecahedron 200 where the dodecahedron poles Pd are placed, the vectors flip to point toward the center 350 between thirty and forty percent of the radius from the center 350 and create a non-adiabatic center 315. The vectors 312 along radii that intersect the center of the faces 320 of the 2V triacon breakdown 300 and that intersect the center of the sides 340 all point in. Also included is a rough drawn field map, FIG. 5*e*, of FIG. 5*c* that is an attempt to give more detail to the field lines 310 in the side view, FIG. 5*c*. This drawing is not meant to be an exact representation, but should give a general view of the nature of the field. With reference to FIG. 5*f*, a contour map illustrates the relative strength of the field represented in the side view of FIG. 5*c*. The contour lines L are in the following sequence—0.05, 0.1, 0.2, 0.4, 0.6, 0.8, 1, 1.2, 1.4, 1.8, 2.5, 3.6, 10, and 20. This illustrates the relative depth of the magnetic well that is formed in each of the structures. The absolute value of the field strength will change depending on the strength of the individual magnets, but the shape and relationship of the intensity of the center 350 to the edge will stay the same, therefore the contour representation is valid for any field strength. The combination of two opposite fields, one from the icosahedron 100 and one from the dodecahedron 200, results in the merging of the "created" pole at the center of one face 220 with the actual pole of the alternate structure Pi. But since the "created" pole 220 in FIG. 4*c* is now of opposite polarity to the actual pole Pi, this essentially forces the flux lines between the poles of the dodecahedron Pd and the poles of the icosahedron Pi at the new points of symmetry 320 and 340. Again the translation to the structure is one in which flux lines 311 point outward along radii that contain poles Pi and Pd, and point inward along the lines of symmetry between all poles, at the center of faces 320 and at the midpoint along the edges 340. Again as in FIG. 4*e* and FIG. 4*f*, poles of opposite polarity can be added at the points of symmetry between poles Pi and Pd of the 2V triacon breakdown 300. FIG. 5*g* as a top view and FIG. 5*h* as a side view show the magnetic vector maps that result in a further triacon breakdown of the icosahedron 100 but one where the added magnets P4*v* are of opposite polarity to the original structure 300. This 4V triacon breakdown 400 adds one magnet P4*v* between every two corners 330 of the 2V triacon breakdown 300, resulting in an additional ninety magnets P4*v*. Again, comparing FIG. 5*a* with FIG. 5*g*, and FIG. 5*c* with FIG. 5*h*, the fields created by the two structures are virtually identical. No minor changes occur at any point in the field. Also, as in FIG. 5*c*, a detail field map, FIG. 5*i*, and intensity contour map, FIG. 5*j*, are illustrated.

Figure 6G:
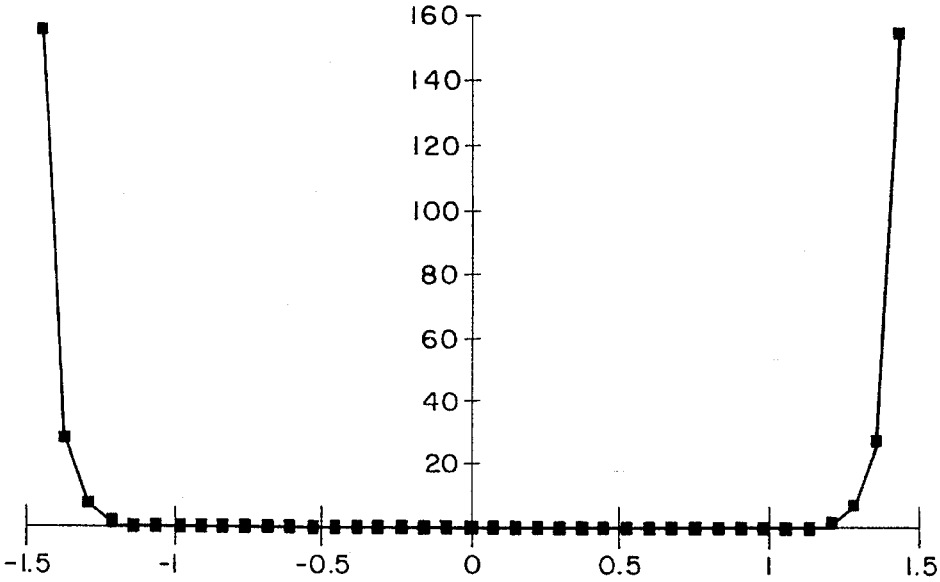
FIG. 6*g* is a linear contour diagram of diagonal D1 from FIG. 6*f*.
Figure 6A:
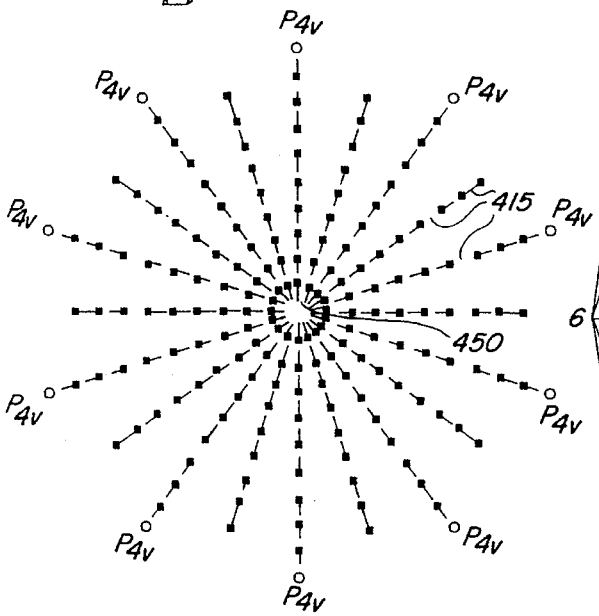
FIG. 6*a* illustrates a field diagram of the top view, FIG. 6*b
Figure 6B:
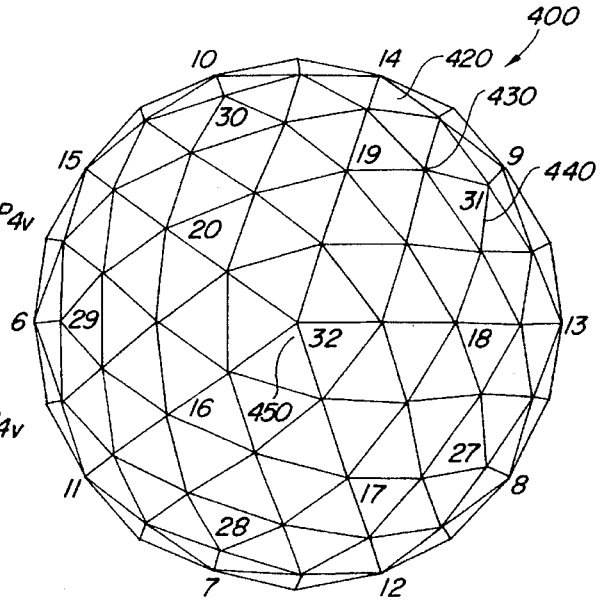
* and FIG. 6*c* illustrates the side view, FIG. 6*d*, of a 4V triacon breakdown, 400, where the added magnets are of similar polarity.
FIG. 6*e* detail is an enhanced field side view of 6*c*.
FIG. 6*f* is a field intensity contour diagram of 6*c*.
FIG. 6*h* is a linear contour diagram of diagonal D2 from FIG. 6*f*.
FIG. 6*i* is FIG. 6*h* but with the vertical axis expanded.
Figure 6C:
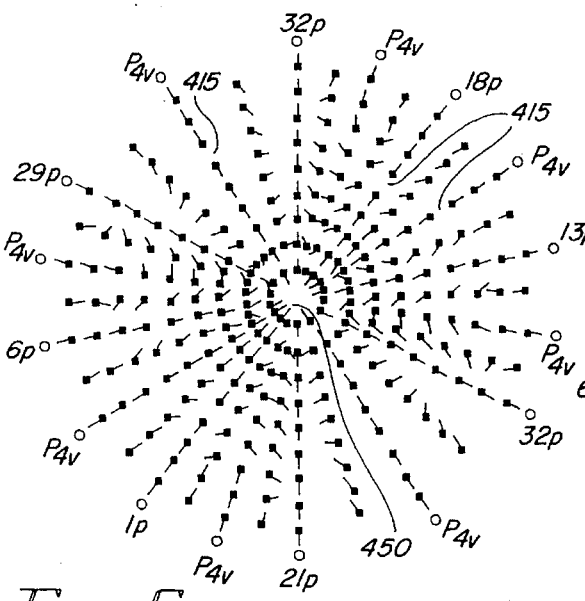
Figure 6D:
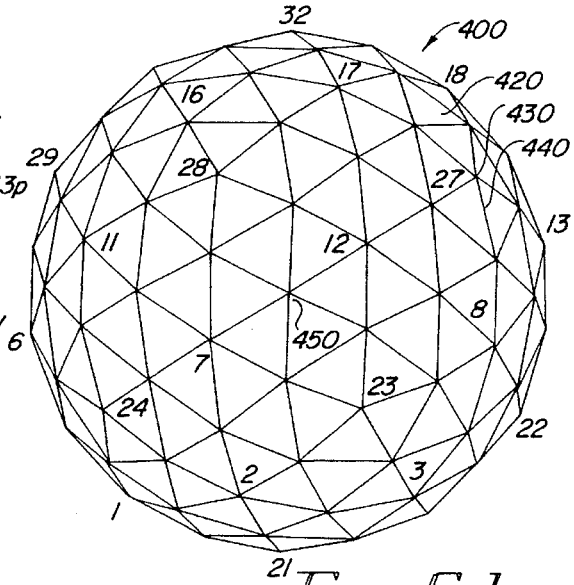
Figure 6F:
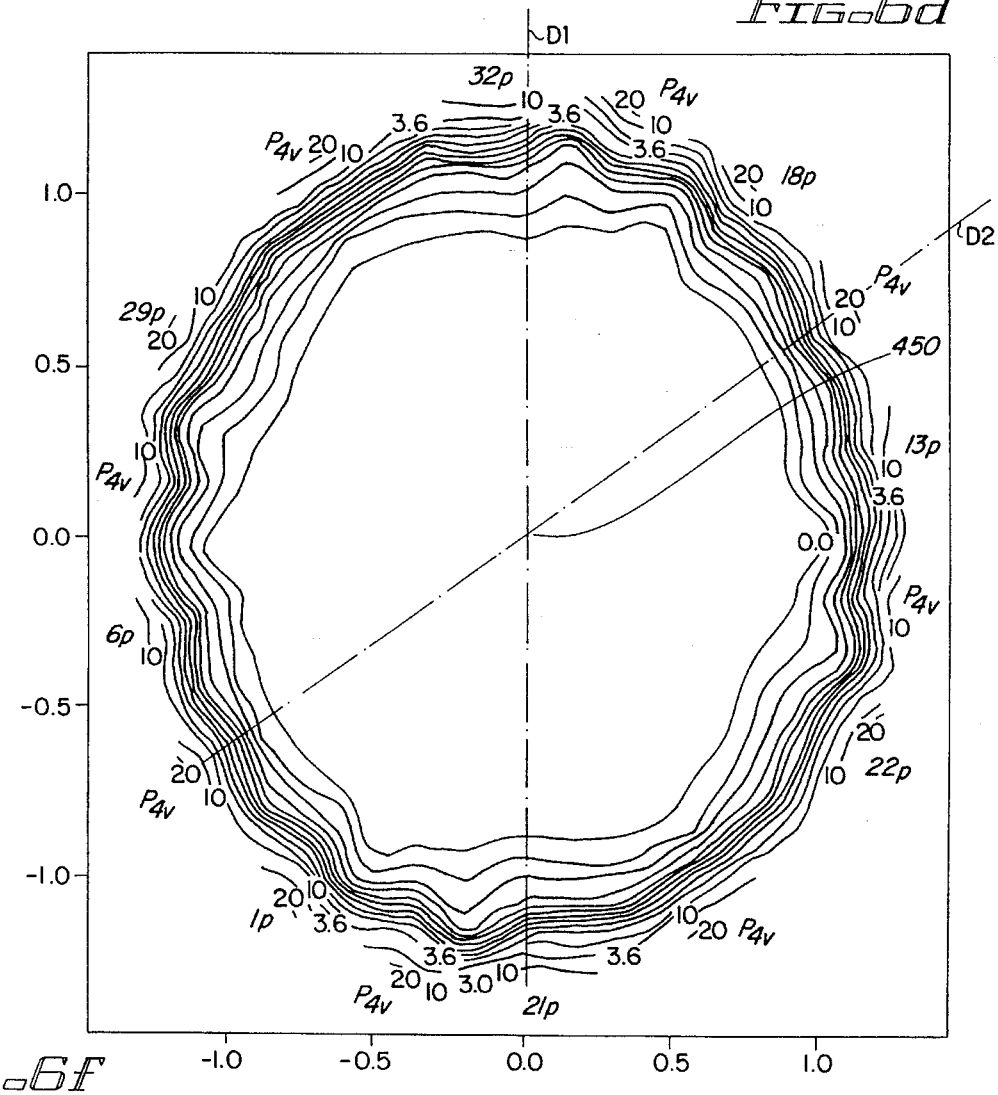
Figure 6E:
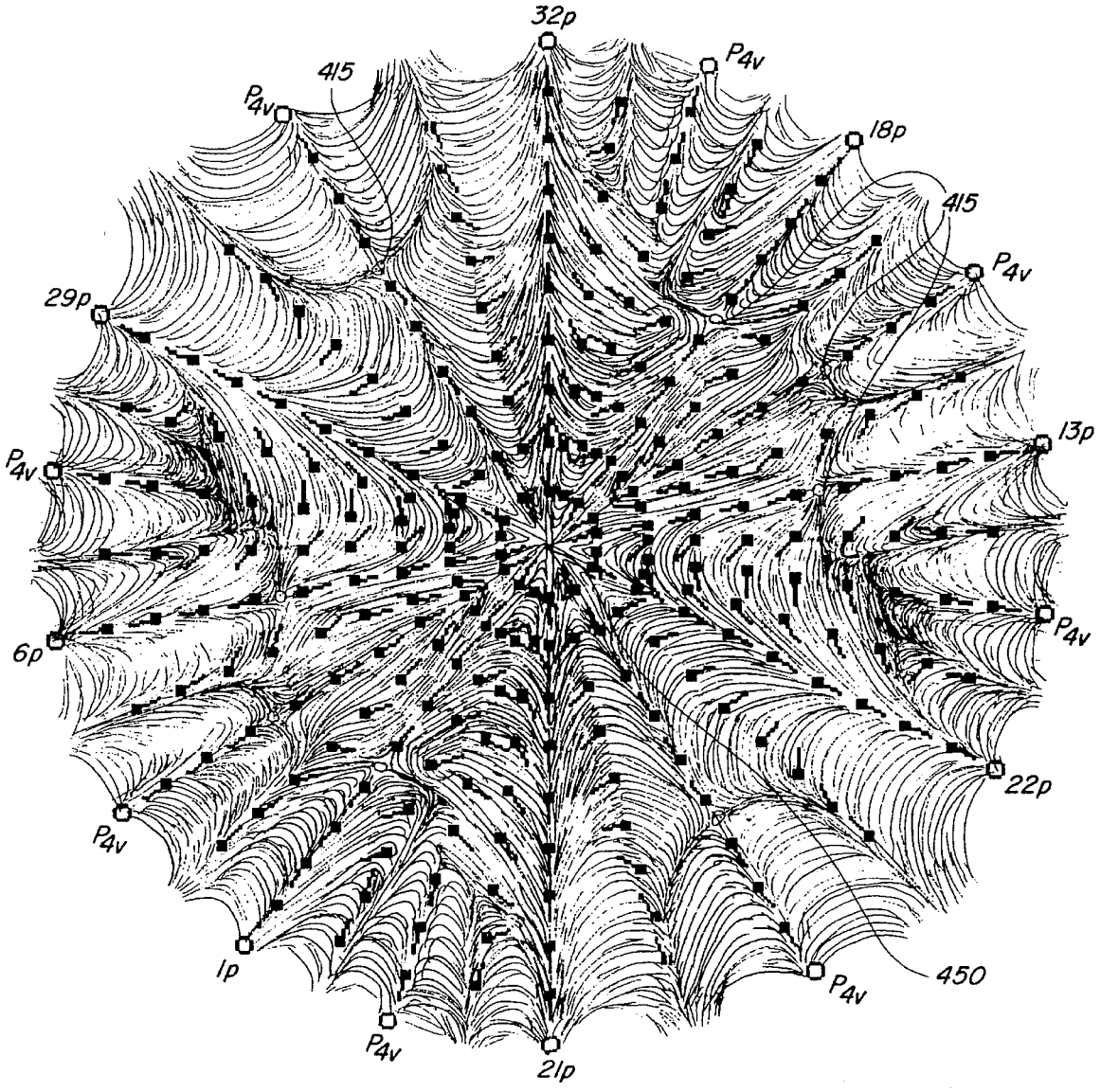
Figure 6H:
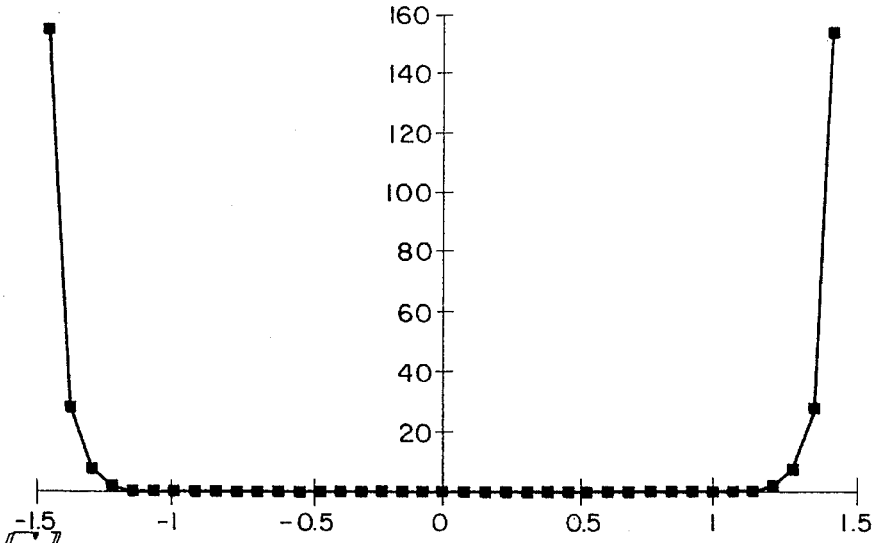
Figure 6I:
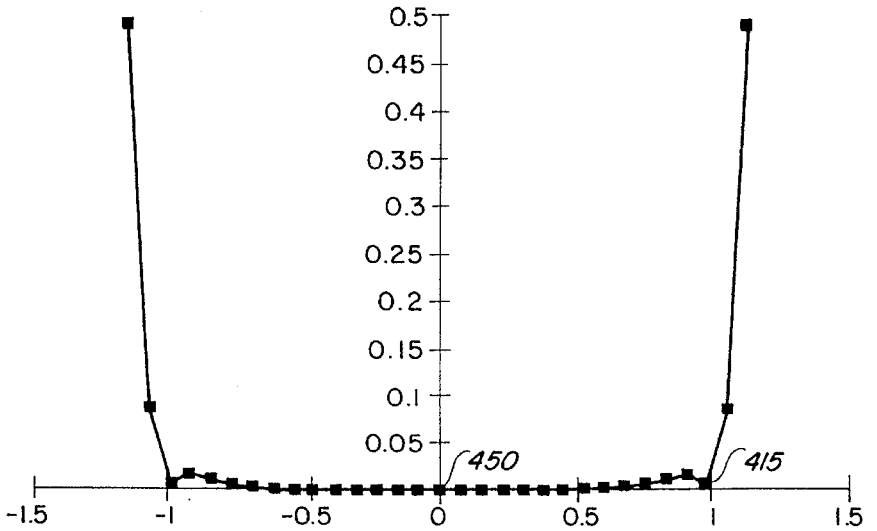

As before, the additional ninety magnets P4*v* can also be added with the same polarity as the original structure, creating a 4V triacon breakdown 400 of common polarity, shown as a field diagram in FIG. 6*a* as a top view and 6*c* as a side view, and as the respective plan view in FIG. 6*b* and FIG. 6*d*, with the accompanying detail field map, FIG. 6*e*, and intensity contour map, FIG. 6*f*, illustrated. To further illustrate the field contour map in FIG. 6*f*, the diameter D1 through the structure that coincides with the top pole 32P and the bottom pole 21P is shown in FIG. 6*g*. The depth and shape of the magnetic well that is formed is easier to visualize in the linear format of FIG. 6*g* that in the planar format of FIG. 6*f*. Each point on the linear format is 5% of the total distance from the center 450 of the structure to the inner poles, with the furthest analysis point from the center at 95% of the total radius, as illustrated in the horizontal axis, where the total radius of 1.511523 is the radius of the shape. The diameter DZ from FIG. 6*f* is shown in FIG. 6*h*. This diameter contains non-adiabatic centers 415 as indicated in FIG. 6*e*. This non-adiabatic center 415 is more obvious in FIG. 6*i*, which is the same graph as FIG. 6*h*, but with the vertical relative magnitude of magnetic flux intensity scale greatly expanded to achieve better resolution. The effect of the additional triacon breakdown, the one that added the P4*v* magnets, and for that matter, any further triacon breakdown, is very minimal on the central field of the structure. The inner thirty to forty percent of any triacon breakdown is very similar to the original icosahedron 100. Differences arise in the outer portion of the field where proximity to the poles begins to exert its effect. And as with all breakdowns analyzed, the addition of more magnets with further breakdowns merely squeezes the flux lines out between the poles, forcing them out at the centers of the new faces and at the midpoint between two adjacent corners. Further breakdowns do not substantially change the inner field, and only add more folds to the edge, with no real change to the general behavior of fields close to the poles.

Figure 7A:
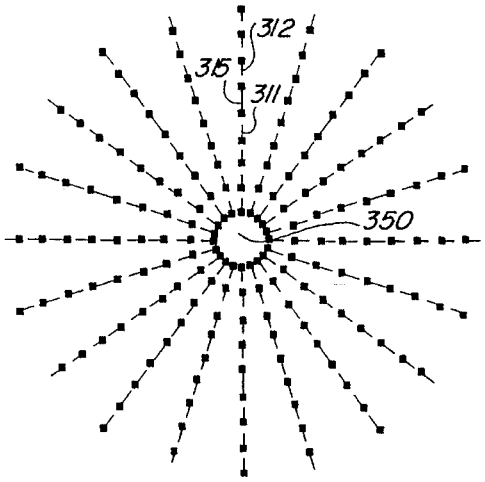
FIG. 7*a* illustrates a field diagram of the top view and FIG. 7*b*, illustrates the side view of a 2V triacon breakdown 300 with the top pole removed.
Figure 7B:
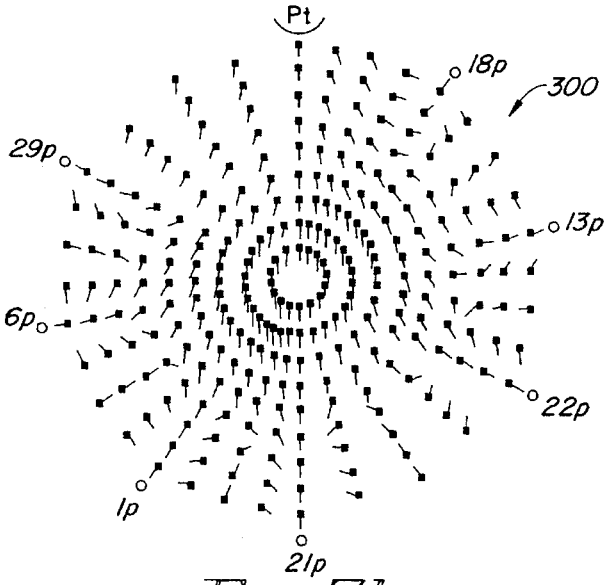
Figure 7C:
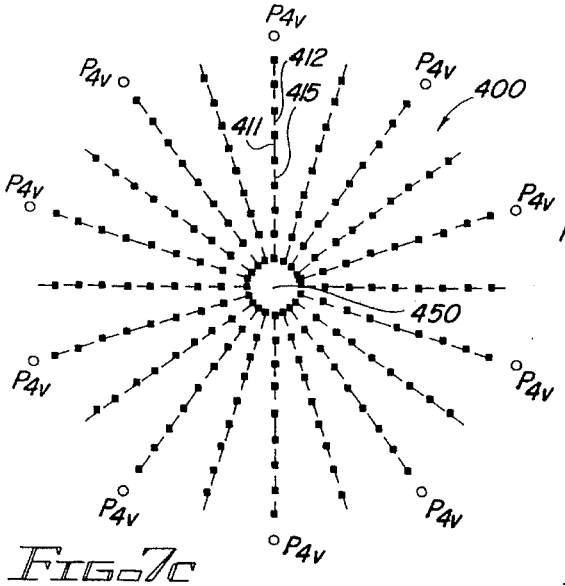
FIG. 7*c* illustrates a field diagram of the top view and FIG. 7*d* illustrates the side view of a 4V triacon breakdown 400 of opposite polarity with the top pole removed.
Figure 7D:
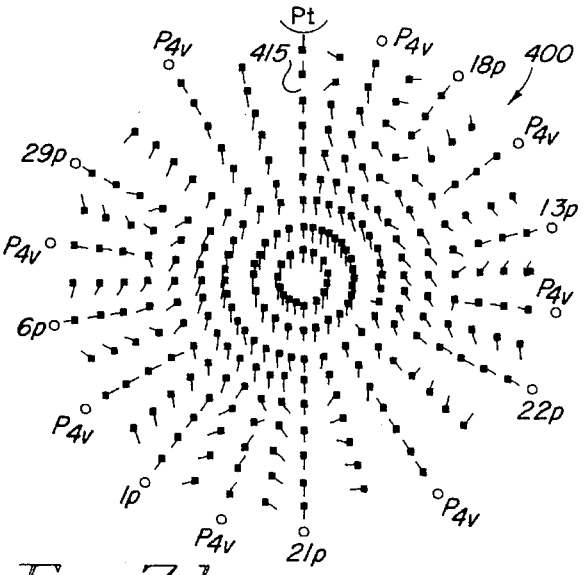
Figure 8A:
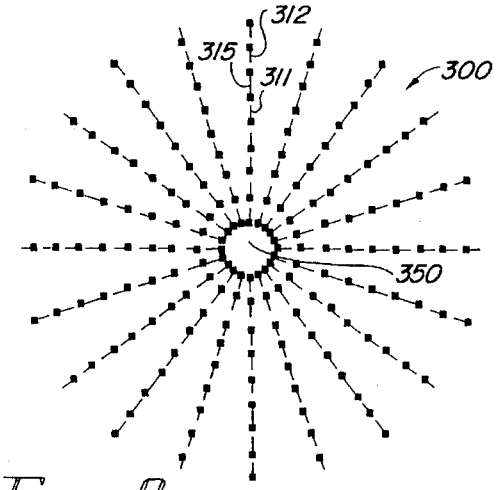
FIG. 8*a* illustrates a field diagram of the top view and FIG. 8*b* illustrates the side view of a 2V triacon breakdown 300 with the top and bottom pole removed.

FIG. 7*a* as a top view and FIG. 7*b* as a side view shows the effect of removing the top pole 32p on a 2V triacon breakdown 300 of an icosahedron. In this case, the center 350 of the structure is no longer non-adiabatic, since the flux density does not drop to zero at the center 350, and, as can be observed in FIG. 7*b*, a single mirror is formed in the inner field region of the structure, with the throat of the mirror at the position of the removed magnet Pt. FIG. 7*c* as a top view and FIG. 7*d* as a side view show a very similar field, but generated by removing the top pole, Pt, of a 4V triacon breakdown 400 where the additional ninety magnets, P4*v*, are of opposite polarity relative to the original 2V triacon breakdown poles, Pi and Pd. By comparing FIG. 7*a* with FIG. 7*c* and FIG. 7*b* with FIG. 7*d*, the comparison fields are virtually identical, with the difference being the creation of a non-adiabatic center 415 in the throat of the mirror by the removed top magnet, Pt. FIG. 8*a* as a top view and FIG. 8*b* as a side view show a similar effect, but this time both the top 32p and bottom 21p pole have been removed. The inner portion of the field has now generalized itself into a field very similar to one generated in a cusped magnetic mirror system. In a cusped magnetic mirror, the current in one of the coils of a simple magnetic mirror is reversed. This configuration has, in addition to the usual mirrors, a spindle-cusp mirror that is perpendicular to the two magnets and at the midpoint between the two, and that extends 360 degrees in azimuth, FIG. 1*f*. The outer portion of the field that is in close proximity to the poles is essentially a multiple cusp. Both fields by themselves can be used to magnetically confine plasma. It is the orientation of the two types of fields to each other that makes the combination an enhancement over either one by themselves. The loss that results from the spindle-cusp mirror that extends 360 degrees in azimuth normally associated with a magnetic cusp is disrupted close to the edge of the sphere by the proximity to the poles of the multiple cups none of which lie directly on the plane 360 of the spindle-cusp mirror. The orientation of the spindle-cusp mirror field to the multiple cusp mirror field is such that there is no straight pathway for the flux lines to escape from the spindle-cusp. The flux line out the top Pt and bottom Pb is the only straight flux pathway in the structure. This spatial orientation would effectively reduce the spindle-cusp loss region 360 relative to a conventional cusp and still maintain the added stability properties of a cusp device over an ordinary mirror. Additionally, the outer multiple cusp would be a secondary confinement scheme for any particles that may have escaped from the primary inner confinement. The effect on the field lines of the spindle-cusp in close proximity to the edge can be seen more clearly in the detail field map, FIG. 8*c*, further illustrating FIG. 8*b*. Additionally, the contour map, FIG. 8*d*, associated with FIG. 8*b* shows the drop in intensity associated with the non-adiabatic centers 315.

Figure 8B:
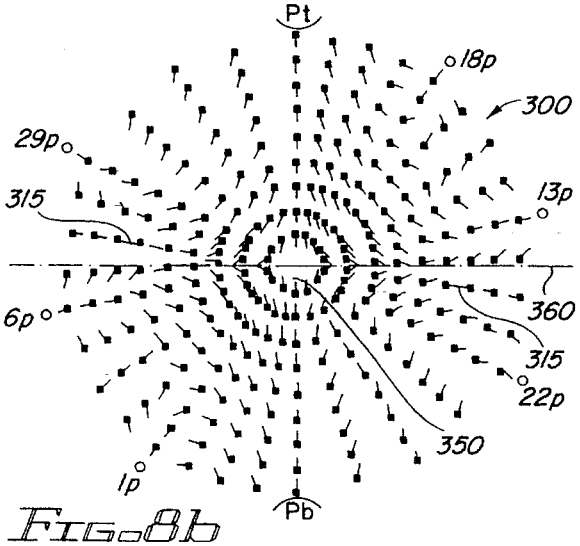
Figure 8E:
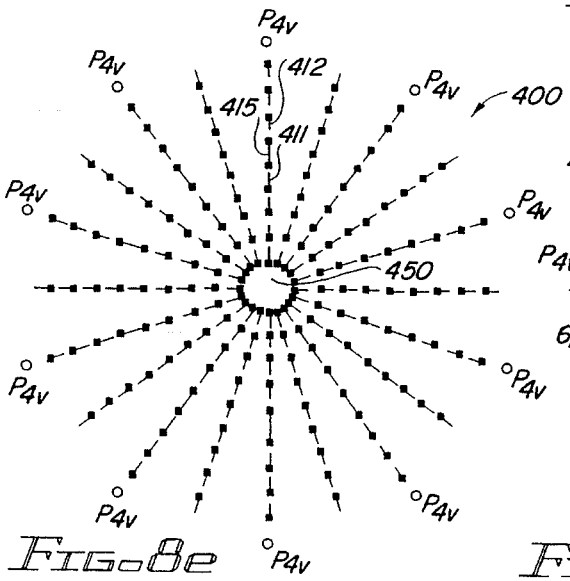
FIG. 8*e* illustrates a field diagram of a top view and FIG. 8*f* illustrates a side view of a 4V triacon breakdown 400 where the additional magnets are of opposite polarity to the original 2V 300, and with the top and bottom pole removed.
Figure 8F:
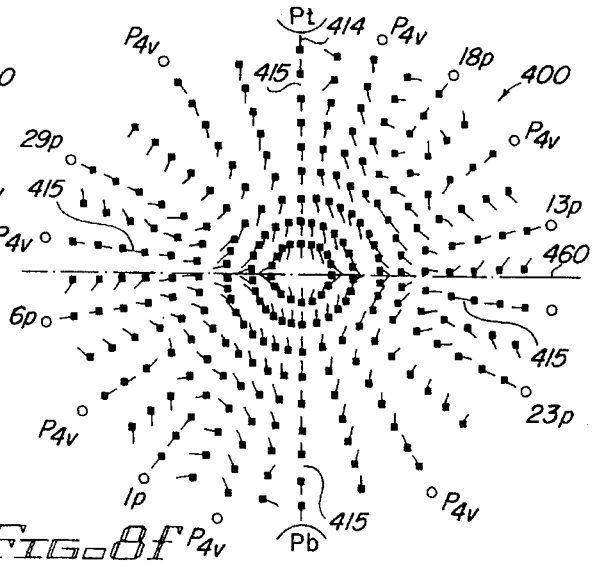
Figure 8C:
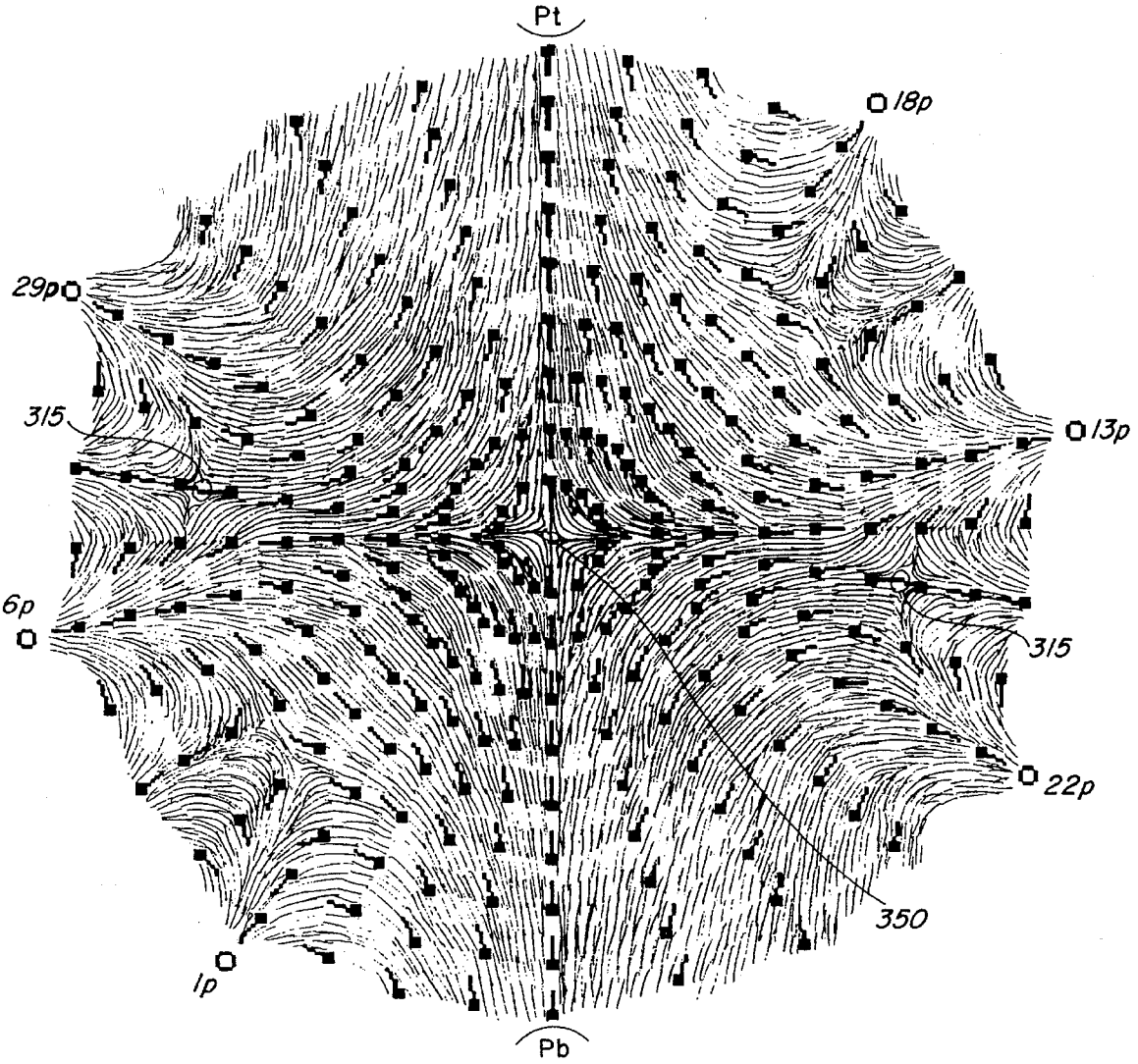
FIG. 8*c* is an enhanced field side view of FIG. 8*b*.
Figure 8H:
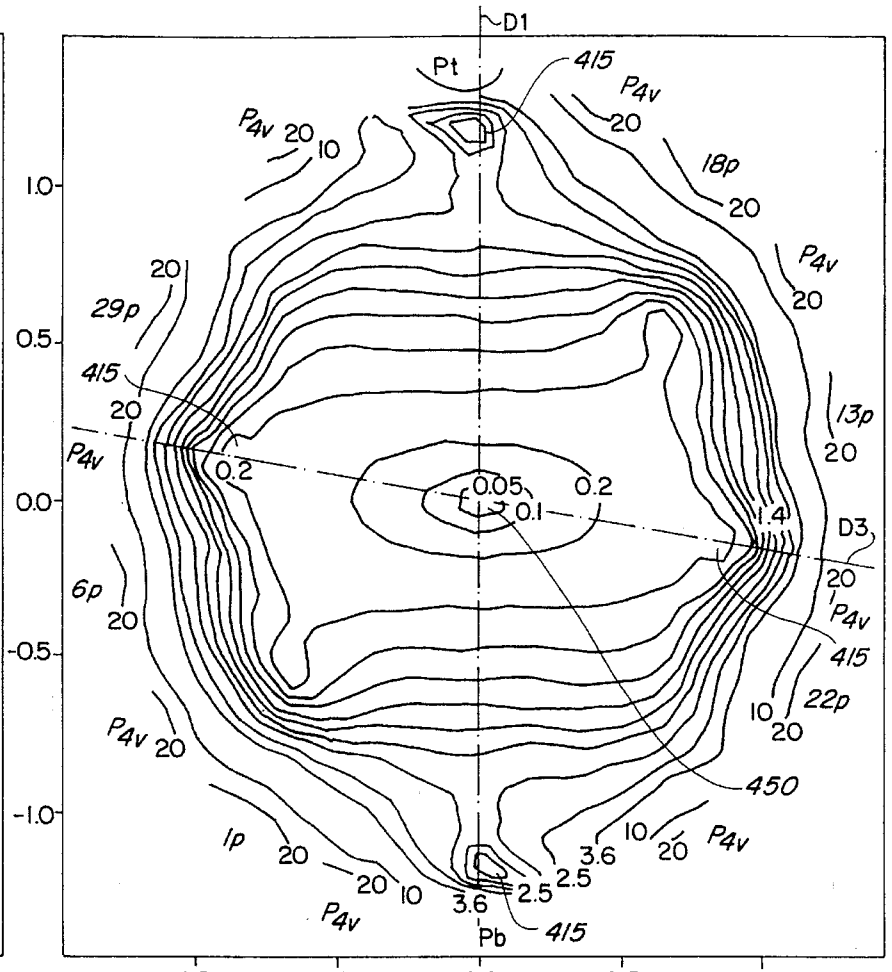
FIG. 8*h* is a field intensity contour diagram of FIG. 8*f*.
Figure 8D:
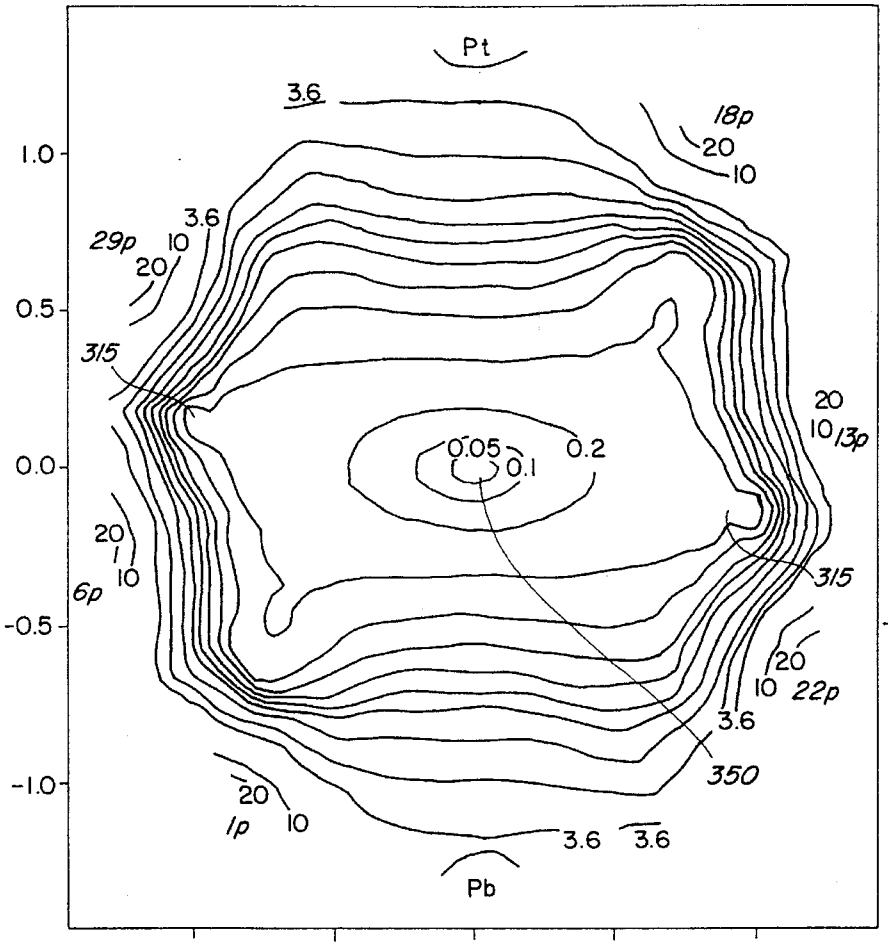
FIG. 8*d* is a field intensity contour diagram of FIG. 8*b*.
Figure 8G:
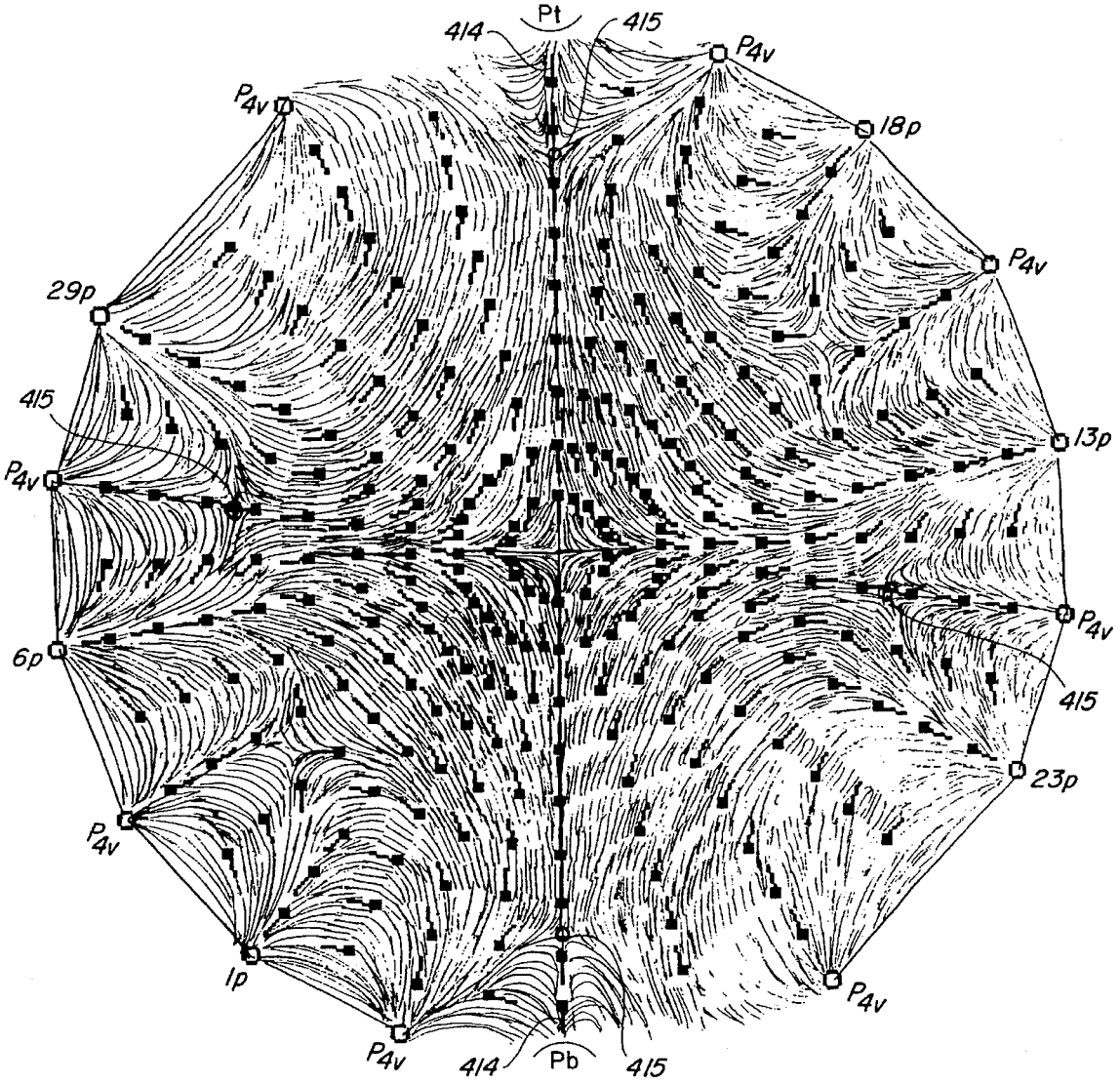
FIG. 8*g* is an enhanced field side view of FIG. 8*f*.
Figure 8I:
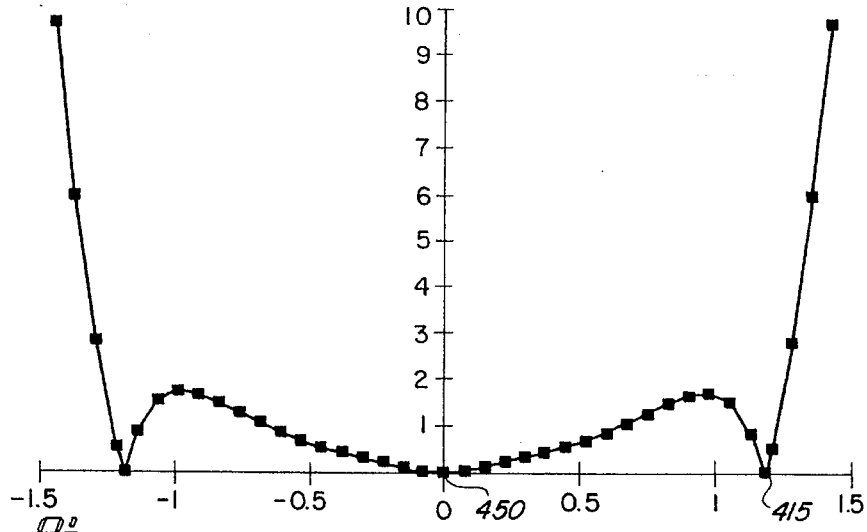
FIG. 8*i* is a linear contour diagram of diagonal D1 from FIG. 8*h*.
Figure 8J:
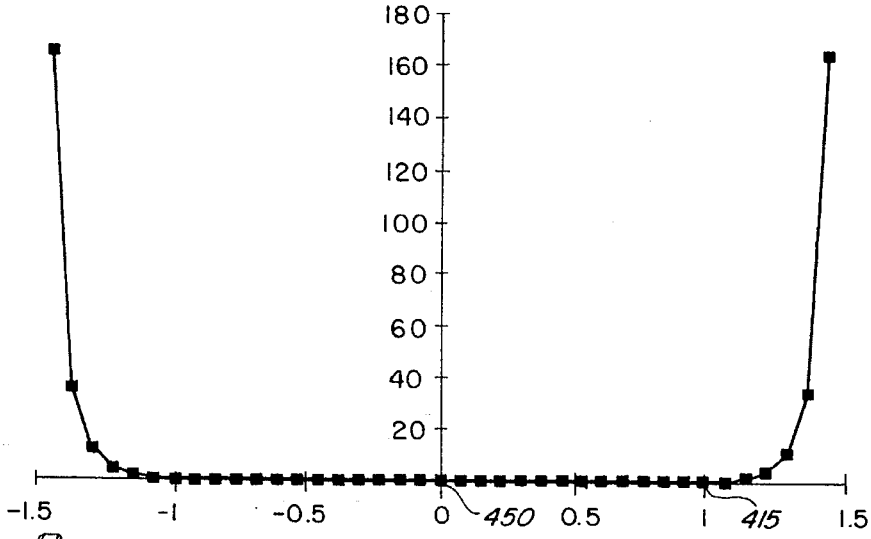
FIG. 8*j* is a linear contour diagram of diagonal D3 from FIG. 8*h*.
Figure 8K:
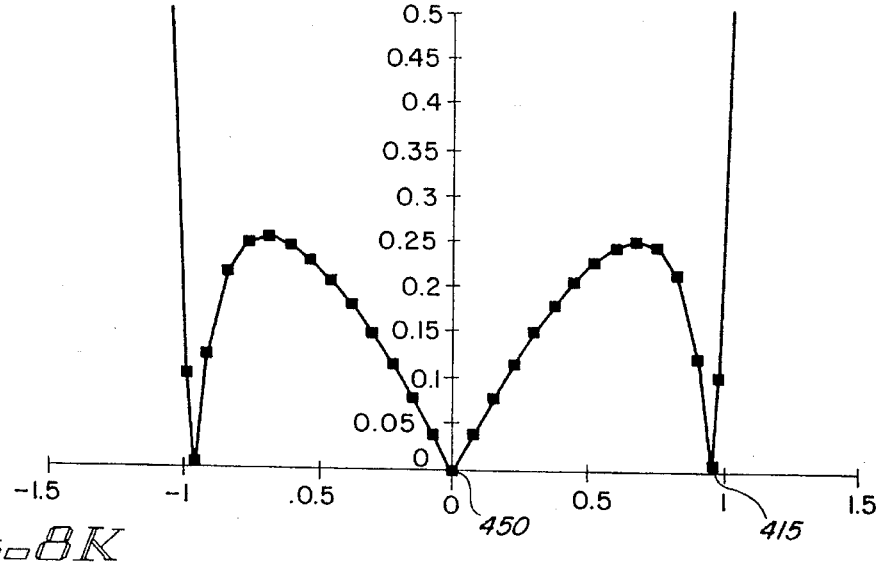
FIG. 8*k* is FIG. 8*j*, but with the vertical axis expanded.
Figure 8L:
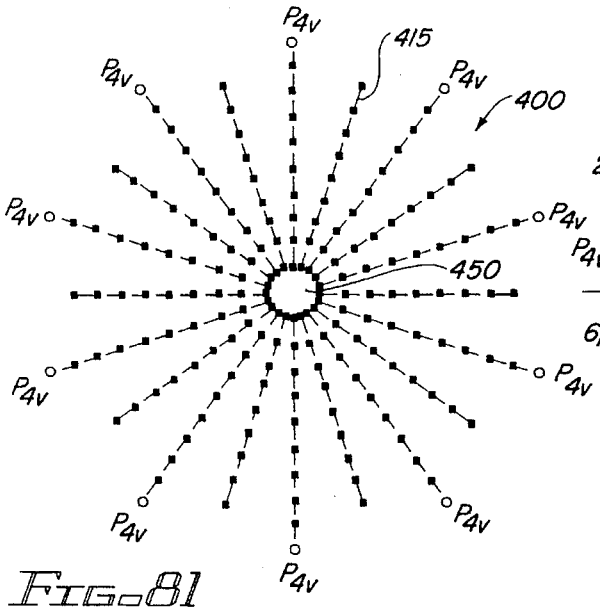
FIG. 8*l* illustrates a field diagram of a top view and FIG. 8*m* illustrates a side view of a 4V triacon breakdown 400, where the additional magnets are of similar polarity to the original 2V 300, and with the top and bottom pole removed.
Figure 8M:
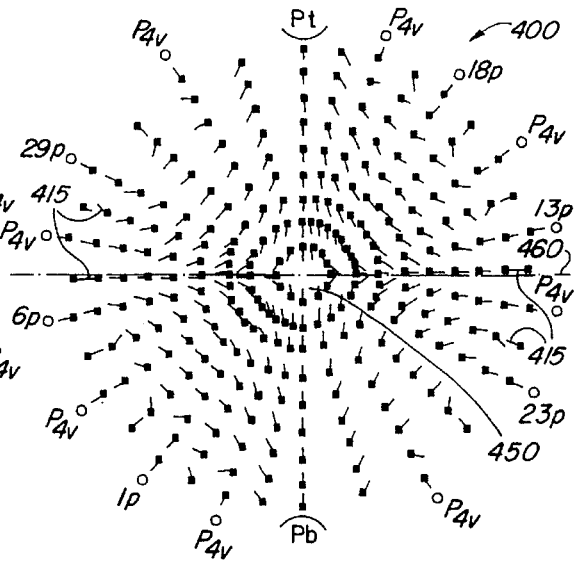
Figure 8O:
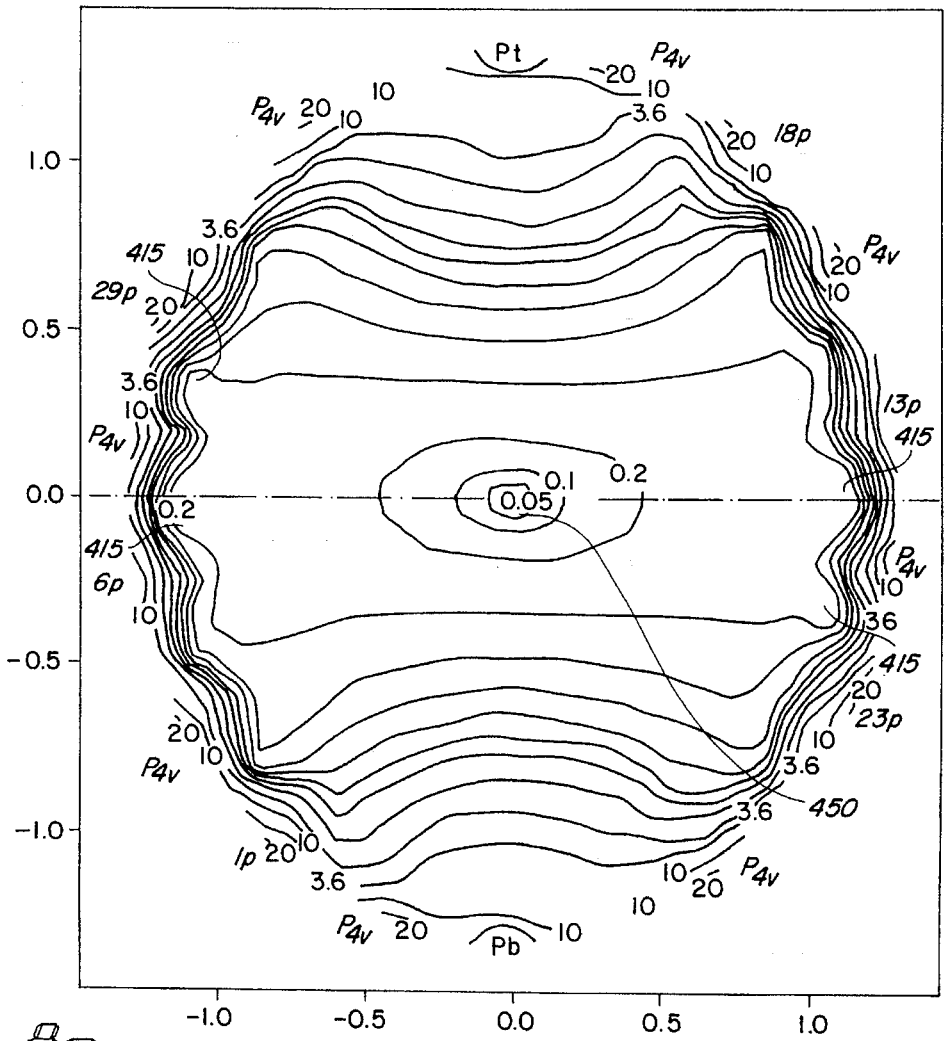
FIG. 8*o* is a field intensity contour diagram of FIG. 8m.
Figure 8N:
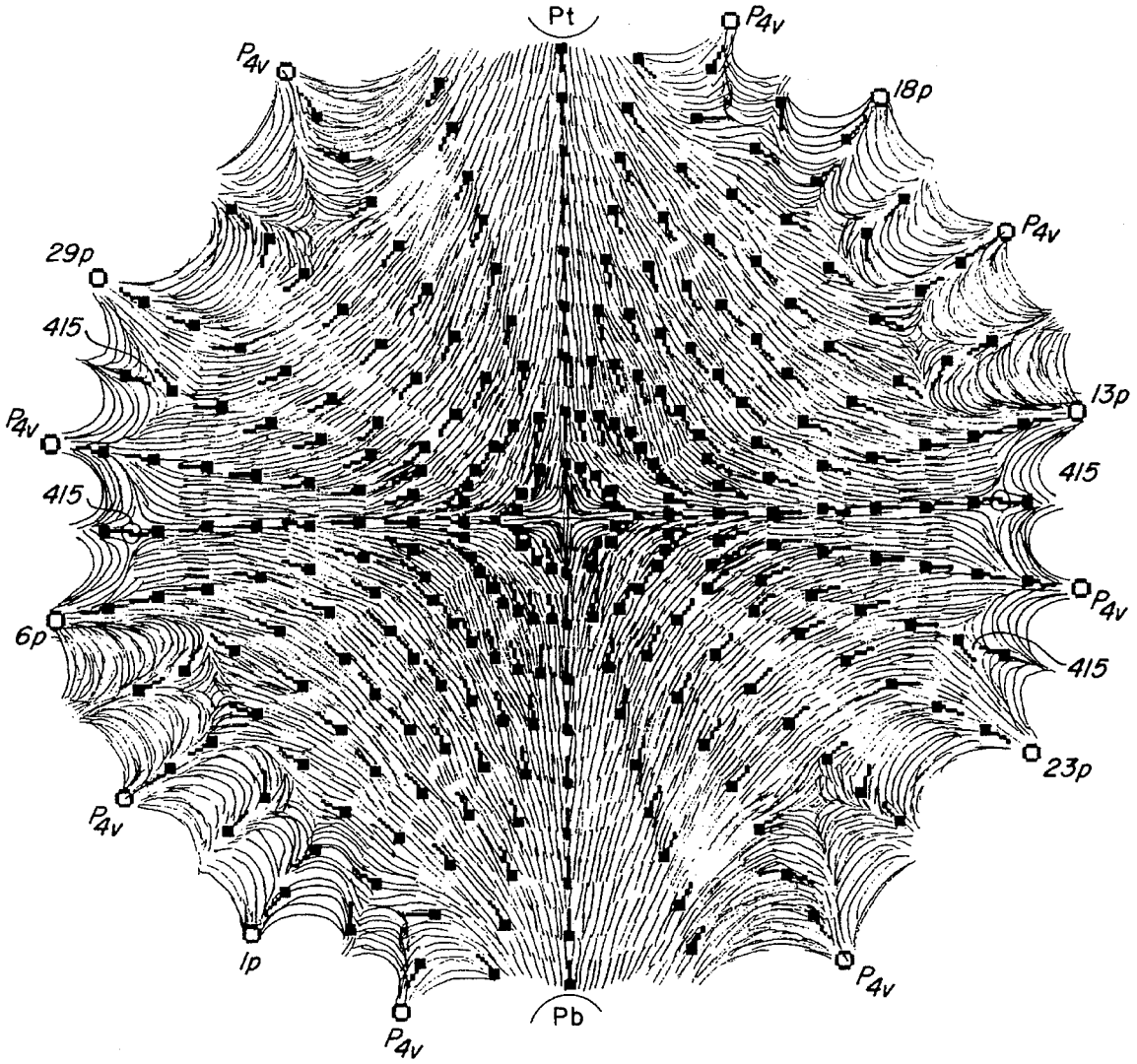
FIG. 8*n* is an enhanced field side view of FIG. 8m.
Figure 8P:
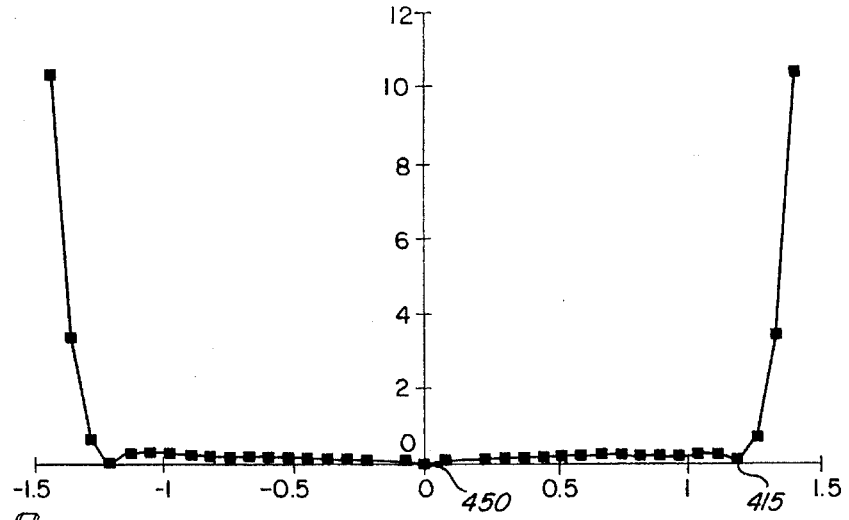
FIG. 8*p* is a linear contour diagram of the diagonal through 460 from FIG. 8*o*.

An unusual result occurs if the 2V triacon breakdown 300 with the top 32p and bottom 21p poles removed, FIG. 8*a* and FIG. 8*b*, is converted to one with a 4V triacon breakdown 400 where the additional ninety magnets P4*v* are of opposite polarity relative to the original 2V triacon breakdown 300. FIG. 8*e* as a top view and FIG. 8*f* as a side view and the associated detail field map, FIG. 8*g*, shows this 4V triacon breakdown 400. The majority of the field of FIG. 8*a* and FIG. 8*b* is identical to that of FIG. 8*e* and FIG. 8*f*, respectively, except for the vector 414 of FIG. 8*f* that contains the top Pt and bottom Pb poles. Between seventy and eighty percent of the radius, the vector 414 flips. This creation of a non-adiabatic center 415 at the top and bottom of FIG. 8*g* is very evident in the contour map, FIG. 8*h*, associated with FIG. 8*f*. This non-adiabatic center 415 is obvious in the linear format of FIG. 8*i* that represents the diameter D1 of FIG. 8*h* which passes through the top and bottom of the structure. Another non-adiabatic center 415 on the diameter D3 is illustrated in FIG. 8*j*, but is easier to identify in FIG. 8*k*, which uses an expanded scale. If the addition of a non-adiabatic center along loss vectors is beneficial to confinement, then this structure would have the additional stability of eliminating the loss vectors 414 associated with the center of the mirrors at the top Pt and bottom Pb. Any particle that was moving out along the vector through Pt or Pb would pass through the non-adiabatic centers 415 and be re-directed away from Pt or Pb. The losses that would normally result from the spindle-cusp mirror 460 of a cusped magnetic mirror system would be reduced by the disruption close to the edge of the structure by the off symmetry proximity to the poles of the multiple cusp, and the losses from the mirrors at the top Pt and bottom Pb could be reduced by the inclusion of the non-adiabatic centers 415 of FIG. 8*f*. The main loss lines left are those associated with the individual mirrors of the multiple cusp. These loss lines are the center of the individual mirrors that are formed at the poles at the corners 430 of the 4V triacon breakdown, and the linear cusps that are formed at the points of symmetry, 420 and 440, between the poles. In the case of the original icosahedron 100, the linear cusps around each mirror form pentagons, with the corners of each pentagon being the centers of the faces 120 of the icosahedron 100. For the dodecahedron 200, the linear cusps between mirrors form triangles, again with the corners of the triangles being the centers of the faces 220 of the dodecahedron 200. In any triacon breakdown of an icosahedron, as by way of example in FIG. 5*c*, the linear cusps around the original poles of the icosahedron Pi still form pentagons, but at all other poles Pd, P4*v*, the linear cusps form hexagons, with all linear cusps being the connection of adjoining centers of faces 320, 420. These linear cusps at the points of symmetry between the original poles Pi of the 2V triacon breakdown 300 could also be reduced as potential loss vectors. If the original 2V triacon breakdown poles Pi, Pd would operate in a DC fashion, and the additional 4V triacon breakdown poles P4*v* would operate in an AC fashion, then the additional ninety magnets P4*v* would switch from being of opposite polarity to being of similar polarity relative to the original 2V triacon breakdown 300, with a drop to zero influence between each polarity cycle. This would have the effect of an internal field that would oscillate between FIG. 8*e* and FIG. 8*f*, when the additional magnets P4*v* were of opposite polarity to the original 2V 300, through FIG. 8*a* and FIG. 8*b*, when the additional magnets P4*v* were not polarized, to FIG. 8*l* and FIG. 8m, when the additional magnets P4*v* are of similar polarity to the original 2V 300. FIG. 81 as a top view and FIG. 8m as a side view is a 4V triacon breakdown 400 of common polarity similar to the one used to generate FIG. 6*a* and FIG. 6*b*, but with the top Pt and bottom Pb pole removed. As before, a detail field map, FIG. 8*n*, and an intensity contour map, FIG. 8*o*, accompany FIG. 8*m*. In the case of FIG. 8*f*, a non-adiabatic center 415 is formed in the center of the top and bottom mirror. But in FIG. 8*m*, the non-adiabatic centers 415 are formed at the spindle-cusp mirror 460, and would serve the same function as in FIG. 8*f*. The non-adiabatic center 415 shown in FIG. 8*m* that lies in the plane 460 that contains the spindle cusp mirror can be seen in the contour map in FIG. 8*o* and in the linear format of FIG. 8*p*. This AC oscillation would keep the linear cusp of the multiple cusp in constant motion. The internal field, or the normal cusped mirror, does not change with these transitions. Only the outer field sees the effect. This combined AC/DC mode may enhance the confinement of the multiple cusp by the continuous motion of the linear cusps that surround the multiple mirrors of the 2V triacon breakdown 300. Also, the particles that interact with the multiple cusp are those that escaped from the inner cusped mirror. The probability distribution of the trajectories of these particles, or the loss vectors associated with the inner cusped mirror, may be such that the inner cusped mirror confinement skews the trajectories of those particles that can escape the inner confinement. This probability distribution of particle trajectories may additionally reduce potential losses from the multiple cusp, by reducing those trajectories that coincide with the loss vectors of the multiple cusp. The main losses in this structure will be on the radii of the corners 430 that contain the poles Pi, Pd and P4*v*. The magnets 11 could be fabricated to be hollow cylinders, which would act like normal solenoids to carry the escaping particles straight out through the magnets themselves, where they could be converted directly into electricity upon exiting.

Figure 9A:
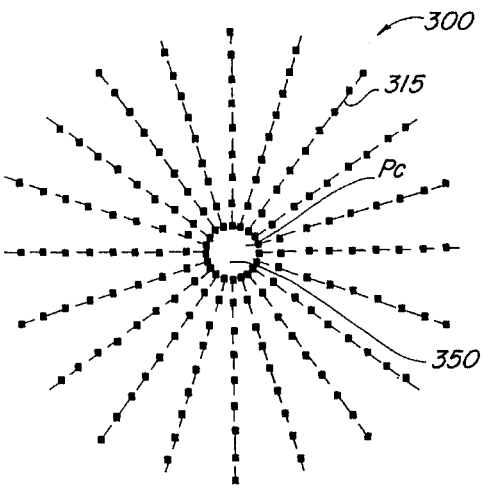
FIG. 9*a* illustrates a field diagram of a top view and FIG. 9*b* illustrates a side view of a 2V triacon breakdown 300 with one pole of an additional magnet inserted through one face and oriented at the center of the icosahedron.
Figure 9B:
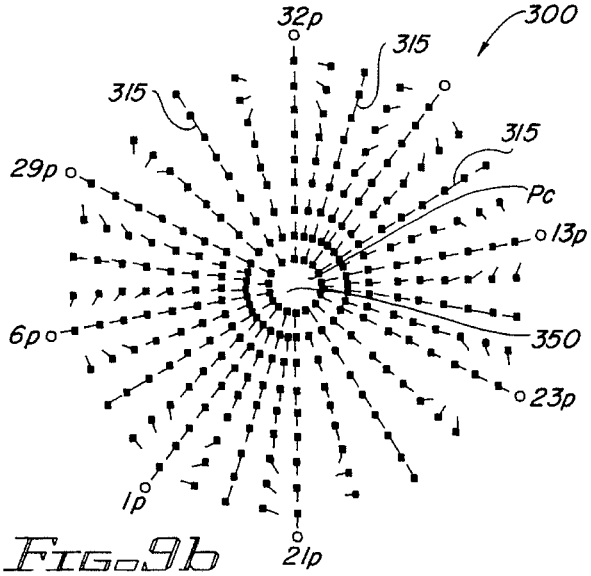
Figure 9D:
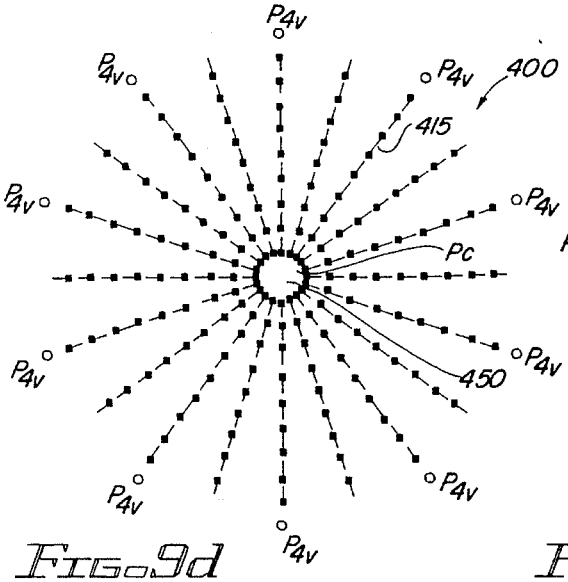
FIG. 9*d* illustrates a field diagram of a top view and FIG. 9*e* illustrates a side view of a 4V triacon breakdown 400 of opposite polarity, with one pole of an additional magnet at its center.
Figure 9E:
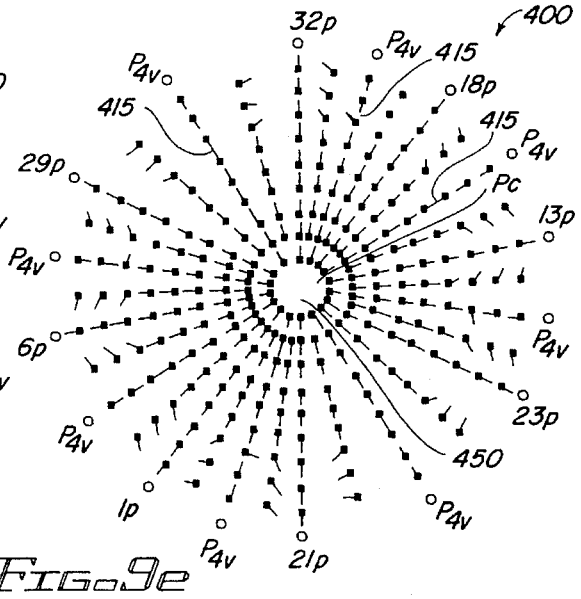
Figure 9H:
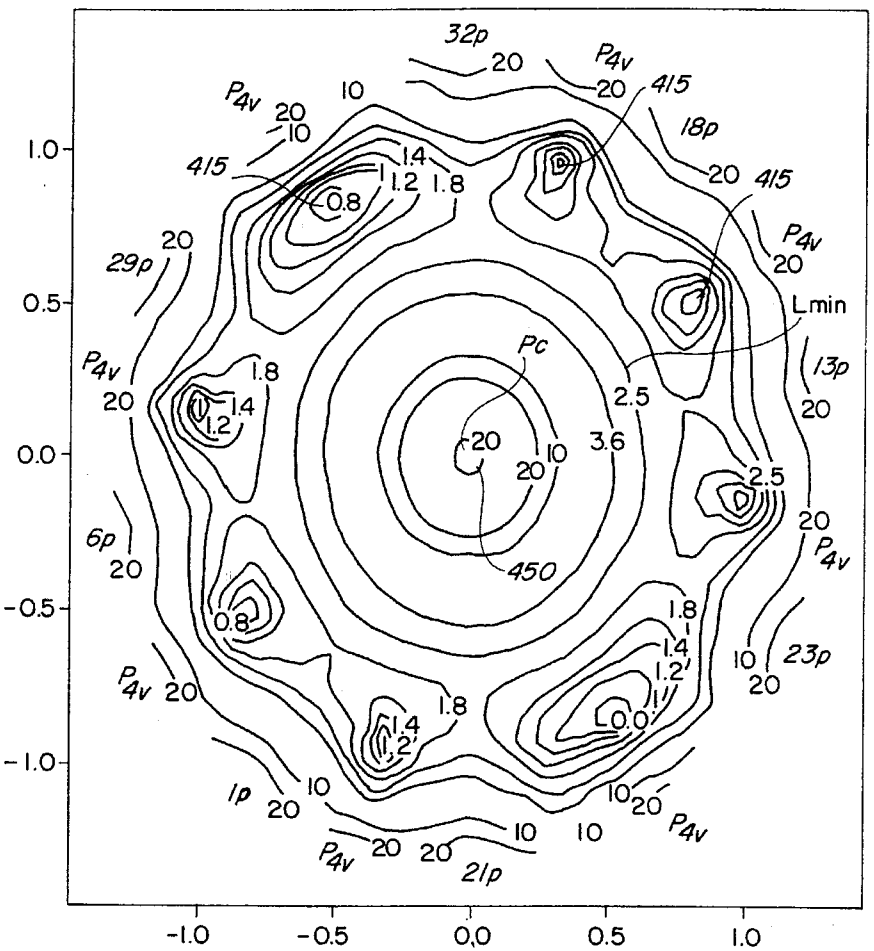
FIG. 9*c* is a field intensity contour diagram of FIG. 9*b*.
FIG. 9*f* is a field intensity contour diagram of FIG. 9*e*.
FIG. 9*g* the same as FIG. 9*d*, and FIG. 9*h*, is the same as FIG. 9*e* but with the inner pole reversed in polarity.
Figure 9G:
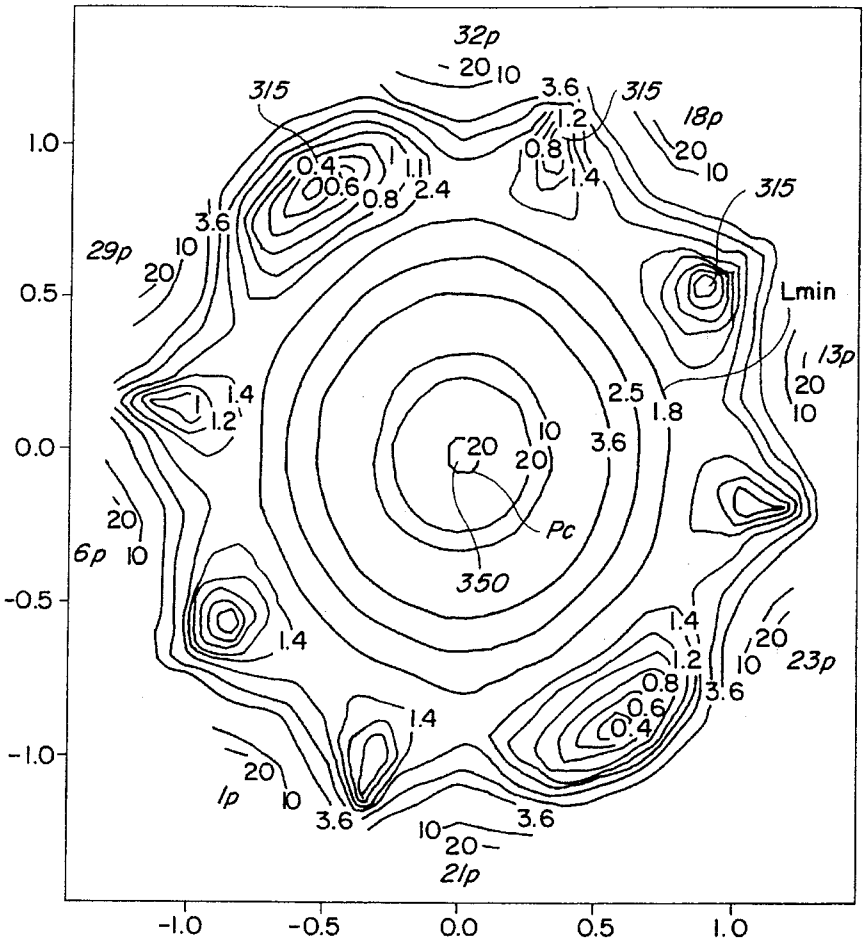
Figure 9G:
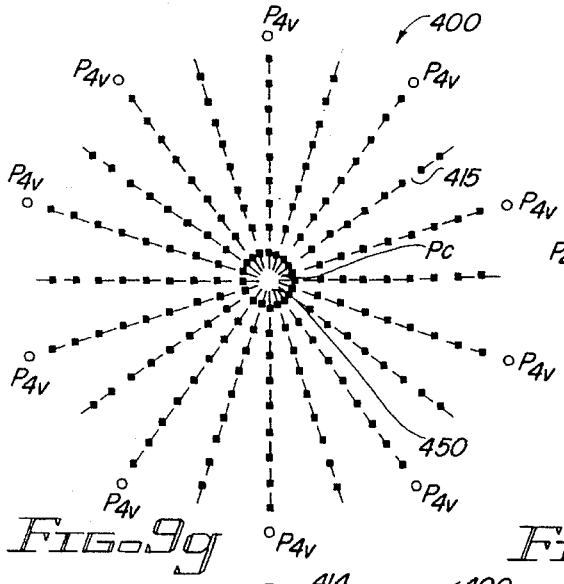
Figure 9H:
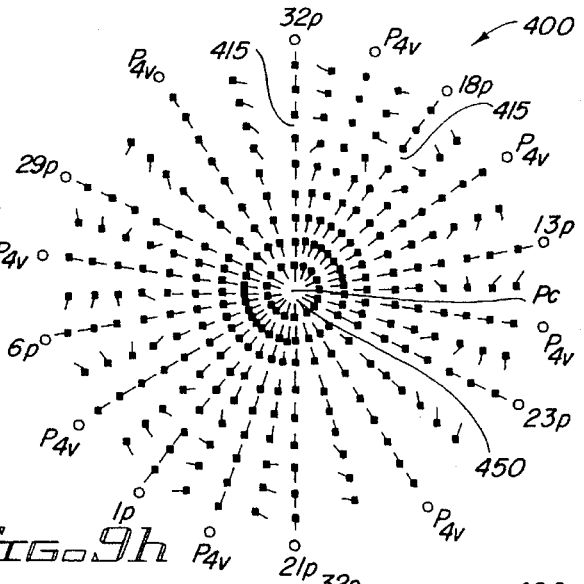

By way of example, consider the field that can be generated by this methodology in which a 2V triacon breakdown 300 has an additional magnet inserted through the center of a face 320, with one pole Pc at the center 350 of the structure and with the outer pole of the additional magnet being placed well beyond the edge of the outer poles of the structure. The pole at the center of the icosahedron Pc is of opposite polarity to the inner poles Pi, Pd of the structure. FIG. 9*a* as a top view and FIG. 9*b* as a side view illustrates the field of such a structure. The inner portion of the field generalizes into a monopole field, while the outer portion still shows the effect of the proximity to the outer poles. When viewed "locally" within the structure, the field is a monopole, but when viewed "globally" external to the structure, no apparent monopole exists. The generation of a "local" monopole field does not violate Maxwell's first law, since "globally" the net integral does not result in a monopole. But anything within the environment of the structure would still react to it as if it were a monopole. In this case, the minimum field density Lmin occurs between the center 350 and the inner poles, Pi and Pd, of the structure, as can be seen in the intensity contour map, FIG. 9*c*, that relates to FIG. 9*b*, with non-adiabatic centers 315 forming close to the edge along the radii that are between any two poles Pi, Pd. FIG. 9*d* as a top view and FIG. 9*e* as a side view and the accompanying intensity contour map, FIG. 9*f*, show a similar field as FIG. 9*a* and FIG. 9*b*, but one generated with the internal magnet Pc inserted into the center 450 of a 4V triacon breakdown 400 where the additional magnets P4*v* are of opposite polarity to the original 2V 300. And finally, FIG. 9*g* as a top view and FIG. 9*h* as a side view illustrates this same structure, but with the internal magnet Pc now of similar polarity to the inner poles Pi, Pd, and P4*v*, of the structure. The effect of reversing the polarity of the center magnet Pc is to change the vectors 410 that the non-adiabatic centers 415 of magnetic reversal occur.

Figure 10A:
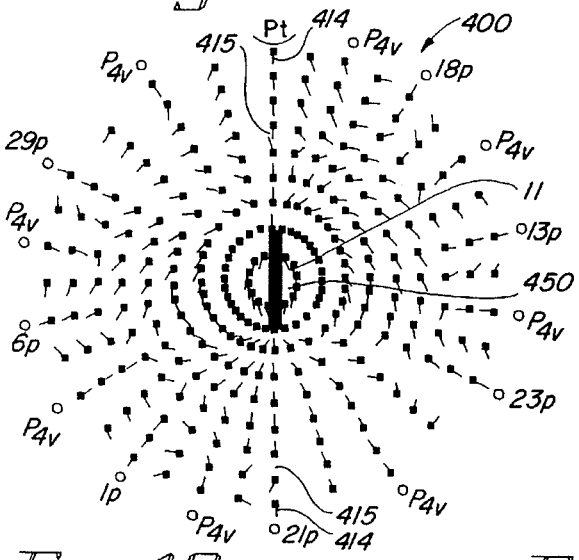
FIG. 10*a* is the same side view as in FIG. 7*d* but one that has an entire magnet inserted into the center, oriented along the symmetry of the original inner mirror.
Figure 10B:
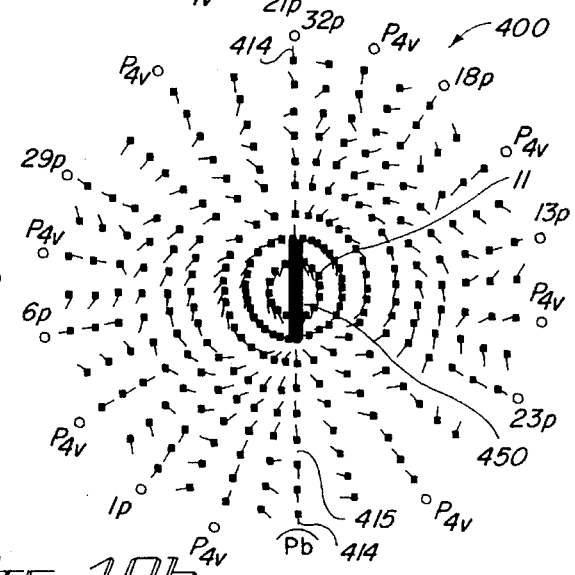
FIG. 10*b* is the same structure as in FIG. 10*a*, but one that has the bottom pole removed instead of the top pole.
Figure 10C:
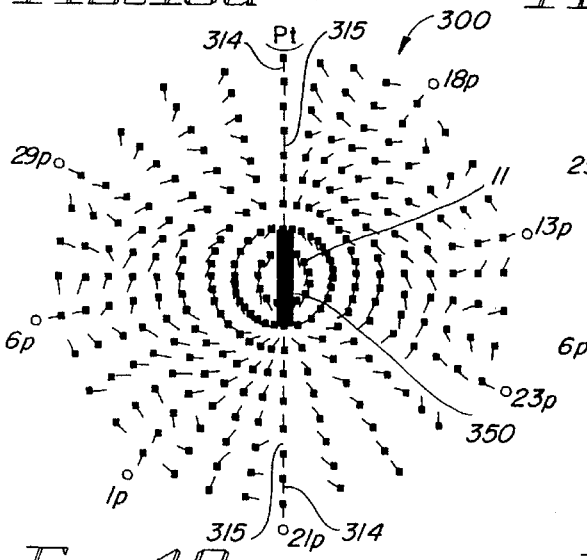
FIG. 10*c* is the same side view as in FIG. 10*a*, but without the additional magnets of the 4V triacon breakdown 400.
Figure 10D:
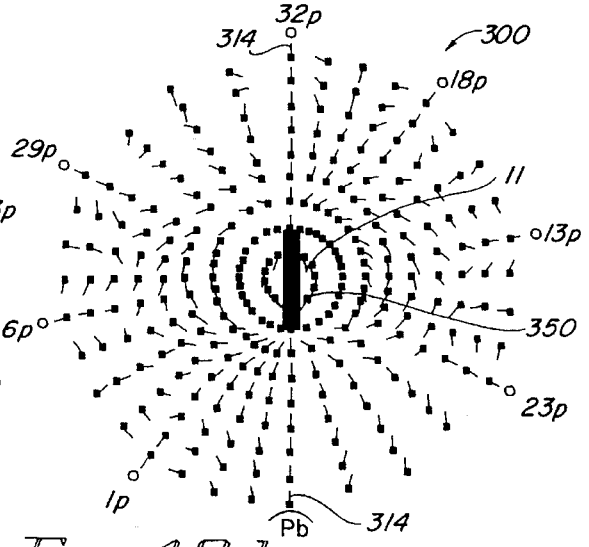
FIG. 10*d* is the same side view as in FIG. 10*b*, but without the additional magnets of the 4V triacon breakdown 400.

Another possibility for inner field formation is the insertion of an entire magnet inside the structure. FIG. 10*a* illustrates the field generated by the addition of a magnet 11 that is equal in length to twenty percent of the inner diameter of the structure, and that is oriented within the single mirror structure formed by FIG. 7*d* and along the axis of symmetry through the missing magnet at the top Pt. The poles of this inner magnet 11 are such that the field of the inner magnet 11 is in the opposite direction relative to the original single mirror formed in FIG. 7*d*. This allows the formation of non-adiabatic centers 415 along the major loss lines 414 at the top Pt and bottom Pb of the structure, and the inner field itself is similar to the magnetic field of the earth, which naturally can confine plasma at the north and south pole through a standard mirror. This approach is similar to the one taken in U.S. Pat. No. 4,618,470, but in that case the external field was quite different. FIG. 10*b* illustrates the field generated by the insertion of the same magnet, but in this case, the bottom magnet Pb instead of the top magnet Pt of the outer structure has been removed, inverting the single mirror structure from FIG. 7*d*. FIG. 10*c* and FIG. 10*d* are the same side views as FIG. 10*a* and FIG. 10*b*, respectively, but FIG. 10*c* and FIG. 10*d* do not have the additional magnets P4*v* of the 4V triacon breakdown 400, and instead only use the magnets Pi and Pd of the 2V triacon breakdown 300.

Other regular solids can be used in a similar fashion to generate symmetrical, spherical arrangements of magnets, and these solids can nest with other solids, like the dodecahedron nests within the icosahedron. The trigonal pyramid will nest with another trigonal pyramid that is inverted, creating an octahedron. The octagon can undergo triacon breakdowns, the first of which will nest the cube. These structures have very similar results when analyzed, with general fields established in the core of triacon breakdowns that are similar to the original structure, and with additional breakdowns having the result of squeezing flux lines between poles at the center of faces and at the midpoint along the sides. Also possible is the nesting of all solids, with trigonal pyramid inside trigonal pyramid inside cube inside octagon inside dodecahedron inside icosahedron, with the possibility of varying the radius with the progression of structures. This final structure is, unfortunately, too complex to be analyzed by the author. The permutations of alignment and relative sizes is quite unmanageable.

Not all of the permutations possible are disclosed in the description or in the diagrams. By way of example, the AC/DC mode can be used in any of the previous structures, where one or more set of magnets is held at a constant polarity and the remaining set or sets of magnets is allowed to oscillate. In all cases, the inner field shape will remain constant with the oscillations, and only the outer field shape and the interface between the inner and outer field shapes will change the oscillations. Also by way of example, the inner field shape of a structure that has two opposing magnets removed will always be similar to a spindle cusp mirror field, independent of whether the structure is a 2V breakdown of opposite polarity or of similar polarity, or whether the structure is a 4V triacon breakdown of opposite polarity or of similar polarity. The choice of structure determines the outer field shape, and the choice of magnet removal or addition determines the inner field shape. The differences in the permutations of the combinations of structure choice and individual magnet removal or addition arise as a result of how the interface between the inner and outer field changes, as the outer field changes with the choice of structure while the inner field remains constant within each choice of individual magnet removal or addition. The 4V triacon breakdown 400 contains all the symmetries of the structures used to generate the field shapes presented. As a result, the 4V triacon breakdown can generate all of the field shapes disclosed in the figures, depending on which of its magnets 11 are turned on and on which polarity is chosen.

It is expected that the method of the present invention will be analyzed mathematically by computer simulation to further determine specific confinement properties, and to maximize the confinement by varying parameters such as shape radius, magnet length, spacing of magnets (to minimize induction effects), and plasma injection angle by way of example. A variety of internal fields can be generated by a symmetrical, spherical arrangement of electromagnets depending on the magnets removed. The resulting inner field will be similar but of reversed polarity to the field produced if only the removed magnets were present and the remaining magnets had been removed.

The fields described can be used in other applications beyond the confinement of ions and plasmas. The structure illustrated in FIG. 9*a* through 9*h* has applications in magnetic bearings, with the additional magnet inserted through a face acting as the axle and the structure acting as the bearing. The structure illustrated in FIG. 10*a* and FIG. 10*b* has applications in gyroscopes, with the internal magnet 11 serving as the axle for an internal gyroscope.

While specific embodiments of the invention have been described in detail herein above, it is to be understood that various modifications may be made from the specific details described herein without departing from the spirit and scope of the invention as set forth in the appended claims.

Having now described the invention and the advantageous new and useful results obtained thereby, the new and useful methods are set forth in the appended claims.

What is claimed is:

1. A method of forming a magnetic field useful in containing charged particles, the method comprising the steps of:

placing each inner pole of a first set of elongated pole magnets at corners of an icosahedron;

extending each magnet axis of the first set radially outward from a geometric center of the icosahedron whereby each outer pole of each magnet lies radially outward from the center;

placing each inner pole of a second set of elongated pole magnets at corners of a dodecahedron;

extending each magnet axis of the second set radially outward from a geometric center of the dodecahedron whereby each outer pole of each magnet lies radially outward from the center;

placing the icosahedron center coincident with the dodecahedron center; and orienting each magnet of the dodecahedron second magnet set for placing each second set dodecahedron inner pole at a center of each face of the icosahedron for forming a magnet structure having an inner field region and an outer field region, the field regions separated by a transition region having non-adiabatic sites.

2. The method as recited in claim 1, wherein the second set inner pole placing step further comprises the step of placing inner poles of opposite polarity to the first pole set for forming a multiple cusp mirror magnetic field within the structure, the field having flux lines at edges of the structure substantially opposing flux lines proximate the center along at least one structure radius, the radius passing through the center, the radius further having non-adiabatic sites proximate the edge of the structure thereby defining a transition region, the center further having a minimum B field condition.

3. The method as recited in claim 1, wherein the step of placing the second set of pole magnets at the dodecahedron corners further comprises the step of placing inner poles of similar polarity to the inner poles of the first set, thereby forming a 2V triacon breakdown of an icosahedron as the structure, further forming the inner field region generally having flux lines substantially opposing flux lines of the outer field region along at least one plane passing through the center, the plane further having non-adiabatic sites between the inner and outer fields, the center further having a minimum B field condition.

4. The method as recited in claim 3, further comprising the step of removing a first pole magnet from its first position within the structure thereby removing the non-adiabatic condition from the center and forming a single mirror field as the inner field, the inner field having a throat of the mirror field aligned along a radius of the first pole magnet first position.

5. The method as recited in claim 4, further comprising the steps of removing a second pole magnet from its second position within the structure, the second pole magnet position radially opposing the first pole magnet position, for forming an opposing single mirror field adjacent the mirror field, the combination of mirror fields forming a spindle cusp mirror as the inner field.

6. The method as recited in claim 3 further comprising the step of placing an additional pole of an additional elongated pole magnet at the center, the additional elongated pole magnet having a length for extending its opposing pole beyond the poles of the first and second sets sufficient for removing any interference effect of the opposing pole on magnetic fields formed by the first and second sets, the additional pole having opposite polarity from the inner poles of the first and second sets for forming a monopole magnetic-styled inner field.

7. The method as recited in claim 4 further comprising the step of placing an entire additional magnet at the center, the additional magnet having both of its poles within the inner field region, the additional magnet further having its axis coincident with the throat for forming non-adiabatic sites along major loss paths through the throat, the additional magnet further forming the inner field as a field reversed mirror field.

8. The method as recited in claim 3, further comprising the steps of:

placing each inner pole of a third set of elongated pole magnets at corners of a 4V triacon breakdown of an icosahedron, the third pole magnet set located at corners unique to a 4V triacon breakdown, the third pole set having opposite polarity to the first pole set and the second pole set;

extending each magnet axis of the third set radially outward from a geometric center of the 4V triacon breakdown whereby each outer pole of each magnet lies radially outward from the center;

placing the 4V triacon breakdown center coincident with the geometric center; and orienting each magnet inner pole of the 4V triacon breakdown set between every corner pair of the 2V triacon breakdown, for forming the inner field region generally having flux lines substantially opposing flux lines of the outer field region along at least one plane passing through the center, the plane further having non-adiabatic sites between the inner and outer field regions, the center further having a minimum B field condition.

9. The method as recited in claim 8, further comprising the step of removing a first pole magnet from a first pole magnet position for removing the non-adiabatic condition from the center thereby forming a single mirror field as the inner field region, the inner field region having a throat of the mirror field aligned along the radius of the first pole magnet position, and further forming a non-adiabatic center in the throat of the single mirror field.

10. The method as recited in claim 9, further comprising the steps of removing a second pole magnet from a second pole magnet position, the second pole magnet position radially opposing the first pole magnet position, for forming an opposing single mirror field adjacent the single mirror field, the combination of fields forming a spindle cusp mirror field as the inner field region, and further forming a non-adiabatic center in the throat of each mirror field.

11. The method as recited in claim 8, further comprising the step of placing an additional pole of an additional elongated pole magnet at the center, the additional elongated pole magnet having a length for extending its opposing pole beyond the poles of the first, second, and third sets sufficient for removing interference effects of the opposing pole on magnetic fields, formed by the pole sets, the additional pole having opposite polarity from the inner poles of the first and second set of pole magnets and similar polarity from the inner poles of the third set of pole magnets, for forming a monopole magnetic-styled inner field, further forming non-adiabatic centers on radii of the structure that contain the third set of elongated pole magnets.

12. The method as recited in claim 8, further comprising the step of placing an additional pole of an additional elongated pole magnet at the center, the additional elongated pole magnet having a length for extending its opposing pole beyond the poles of the first, second and third sets sufficient for removing interference effects of the opposing pole on magnetic fields formed by the pole sets, the additional pole having similar polarity to the inner poles of the first and second set of pole magnets and opposite polarity from the inner poles of the third set of pole magnets, for forming a monopole magnetic-styled inner field region, further forming non-adiabatic centers on radii of the structure that contain the first and second set of elongated pole magnets.

13. The method as recited in claim 9 further comprising the step of placing an entire additional magnet at the center, the additional magnet having both of its poles within the inner field region, the additional magnet further having its axis coincident with the throat for forming non-adiabatic sites along major loss paths through the throat and extending the non-adiabatic sites outward from the center thereby increasing the inner field region, the additional magnet placement further forming the inner field as a field reversed mirror field.

14. The method as recited in claim 3, further comprising the step of placing each inner pole of a third set of pole magnets at corners of a 4V triacon breakdown of an icosahedron, wherein each of the placed inner poles have similar polarity to the inner poles of the first and second set, thereby forming a 4V triacon breakdown of common polarity as the structure, with the inner field region generally having flux lines substantially opposing flux lines of the outer field region along at least one plane passing through the geometric center, the plane further having non-adiabatic sites between the inner and outer field regions, the non-adiabatic sites positioned for geometrically increasing the inner field region, the center further having a minimum B field condition.

15. The method as recited in claim 14, further comprising the steps of removing a first pole magnet from a first pole magnet position and removing a second pole magnet from a second pole magnet position, the second pole magnet position radially opposing the first pole magnet position, thus forming an opposing single mirror field adjacent the mirror field, the combination of fields forming a spindle cusp mirror field as the inner field region, and further forming non-adiabatic sites in a spindle cusp plane, the spindle cusp plane passing through the geometric center.

16. The method as recited in claim 10, further comprising the step of placing each inner pole of a third set of pole magnets at corners of a 4V triacon breakdown of an icosahedron, wherein each of the placed magnets have inner poles of alternating polarity as the third set, for forming an oscillating outer field while maintaining a stationary inner field, and further forming oscillating non-adiabatic sites that oscillate between the throat of the two mirror fields and the spindle cusp mirror field.

17. A method of forming a magnetic field useful in containing charged particles, the method comprising the steps of:

placing inner poles of elongated pole magnets at corners of a 4V triacon breakdown of an icosahedron;

extending each magnet axis radially outward from a geometric center of the icosahedron whereby each outer pole lies radially outward from the center;

controlling the intensity and polarity of each inner pole for forming a containment field.

18. The method as recited in claim 17, wherein the containment field further comprises an inner field region and an outer field region defined by non-adiabatic sites between the fields.

* * * * *